US011150581B2

(12) United States Patent
Yamashita et al.

(10) Patent No.: US 11,150,581 B2
(45) Date of Patent: Oct. 19, 2021

(54) IMAGE FORMING APPARATUS THAT CAN FORM A NIP IMAGE CORRESPONDING TO A FIXING NIP SHAPE

(71) Applicant: CANON KABUSHIKI KAISHA, Tokyo (JP)

(72) Inventors: Kentaro Yamashita, Suntou-gun (JP); Shun-ichi Ebihara, Suntou-gun (JP); Masahiro Suzuki, Numazu (JP); Mahito Yoshioka, Numazu (JP); Yoshiro Saito, Susono (JP); Satoshi Saito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/985,385

(22) Filed: Aug. 5, 2020

(65) Prior Publication Data

US 2021/0063922 A1 Mar. 4, 2021

(30) Foreign Application Priority Data

Aug. 30, 2019 (JP) ..... JP2019-159000
Aug. 30, 2019 (JP) ..... JP2019-159001

(51) Int. Cl.
*G03G 15/20* (2006.01)
*G03G 15/00* (2006.01)

(52) U.S. Cl.
CPC ..... *G03G 15/2039* (2013.01); *G03G 15/2053* (2013.01); *G03G 15/2064* (2013.01); *G03G 15/657* (2013.01); *G03G 2215/2032* (2013.01)

(58) Field of Classification Search
USPC ..... 399/69
See application file for complete search history.

(56) References Cited

U.S. PATENT DOCUMENTS

| | | | | |
|---|---|---|---|---|
| 8,744,296 | B2 | 6/2014 | Fukuzawa et al. | |
| 2011/0311246 | A1* | 12/2011 | Masuda | G03G 15/2039 399/33 |
| 2016/0370741 | A1* | 12/2016 | Hayashi | G03G 15/2039 |
| 2017/0363996 | A1* | 12/2017 | Kikuchi | G03G 15/2028 |

FOREIGN PATENT DOCUMENTS

| | | | |
|---|---|---|---|
| JP | 7-104604 | A | 4/1995 |
| JP | 7-319314 | A | 12/1995 |
| JP | 8-16025 | A | 1/1996 |

(Continued)

*Primary Examiner* — Q Grainger
(74) *Attorney, Agent, or Firm* — Venable LLP

(57) ABSTRACT

An image forming apparatus includes an image bearing member configured to bear a non-fixed toner image, a transfer portion configured to transfer the non-fixed toner image onto a sheet at a transfer nip, a fixing portion including a first rotary member, a second rotary member and a heating portion configured to heat the first rotary member, a control portion configured to execute a nip image forming process of forming a nip image, on the sheet, corresponding to a shape of the fixing nip, and a reading unit configured to read the nip image, wherein the control portion sets the heating portion to a first temperature in a case where the non-fixed toner image passes through the fixing nip and sets the heating portion to a second temperature which is lower than the first temperature in a case where the nip image passes through the fixing nip.

23 Claims, 23 Drawing Sheets

(56) References Cited

FOREIGN PATENT DOCUMENTS

| | | | | | |
|---|---|---|---|---|---|
| JP | 09185272 | A | * | 7/1997 | |
| JP | 10003232 | A | * | 8/1998 | |
| JP | 2001-22219 | A | | 1/2001 | |
| JP | 2003-167458 | A | | 6/2003 | |
| JP | 2006-167458 | A | | 6/2003 | |
| JP | 2009020153 | A | * | 9/2009 | ..... G03G 15/2039 |

* cited by examiner

IMAGE FORMING APPARATUS THAT CAN FORM A NIP IMAGE CORRESPONDING TO A FIXING NIP SHAPE

BACKGROUND OF THE INVENTION

Field of the Invention

The present invention relates to an image forming apparatus configured to form an image on a sheet.

Description of the Related Art

In general, an image forming apparatus such as an electrophotographic printer is provided with a fixing unit configured to fix a toner image, which has been transferred onto a sheet, to the sheet. The fixing unit includes a fixing roller and a pressure roller and fixes the toner image to the sheet by applying heat and pressure to the sheet at a fixing nip formed by these fixing roller and pressure roller. By the way, hardness of the pressure roller drops due to deterioration in durability and thereby a width of the fixing nip increases.

Fixability of a toner image to a sheet is swayed by temperature and pressure applied to the toner image within the fixing nip and a time during which the toner image passes through the fixing nip. If the width of the fixing nip increases, the time during which the toner image passes through the fixing nip is prolonged, possibly causing image defects or the like. Then, there has been known a technology of forming a measurement sheet on which an image for measuring the width of the fixing nip is formed to that end. A black image is formed at first on the measurement sheet and then the fixing unit is stopped for a certain time in a state in which the black image is nipped by the fixing nip. Then, a trace of the nip where glossiness of only a part nipped by the fixing nip of the black image is different is formed. Then, a user can obtain the width of the fixing nip by measuring the trace of the nip by a caliper and the like. Such control of adjusting the temperature of the fixing nip corresponding to the width of the fixing nip has been made so that heat applied from the fixing nip to the sheet stays within a predetermined range.

Hitherto, there has been proposed an image forming apparatus configured to form a trace of a nip on a black image by conveying a measurement sheet, on which the black image has been formed to the fixing nip such that a surface and a back of the measurement sheet is reversed, to cause the pressure roller press the black image as disclosed in Japanese Patent Application Laid-open No. 2003-167458 for example Still further, Japanese Patent Application Laid-open No. H7-104604 has proposed an image forming apparatus configured to change a sheet conveyance direction after when a trailing edge of a measurement sheet on which a black image has been formed passes through the fixing nip to cause the fixing nip to nip the measurement sheet again.

However, in a case where the measurement sheet of the black image on which the trace of the nip has been formed passes again through the fixing unit, toner at the trace of the nip is melted again by heat of the fixing unit and a boundary of the trace of the nip becomes obscure. Still further, there is a case where the boundary of the trace of the nip formed on the monochromatic black image becomes obscure depending on characteristics of the toner used for the measurement sheet and on surface nature of the sheet. Due to that, there has been a possibility that accuracy in measuring the width of the fixing nip from the trace of the nip drops.

SUMMARY OF THE INVENTION

According to a first aspect of the present invention, an image forming apparatus includes an image bearing member configured to bear a non-fixed toner image, a transfer portion configured to form a transfer nip together with the image bearing member and to transfer the non-fixed toner image borne on the image bearing member onto a sheet at the transfer nip, a fixing portion including a first rotary member, a second rotary member forming a fixing nip together with the first rotary member and a heating portion configured to heat the first rotary member, the fixing portion being configured to fix the non-fixed toner image which has been transferred onto the sheet to the sheet as a fixed toner image by heat and pressure at the fixing nip, a re-conveyance portion configured to convey the sheet that has passed through the fixing portion toward the fixing portion again, a control portion configured to execute a nip image forming process of forming a nip image, on the sheet, corresponding to a shape of the fixing nip by stopping a conveyance of the sheet being conveyed by the fixing portion in a state in which the fixed toner image formed on the sheet is nipped by the fixing nip, and a reading unit configured to read the nip image, wherein the control portion sets the heating portion to a first temperature in a case where the non-fixed toner image passes through the fixing nip and sets the heating portion to a second temperature which is lower than the first temperature in a case where the nip image passes through the fixing nip from when the nip image has been formed on the sheet until when the reading unit reads the nip image.

According to a second aspect of the present invention, an image forming apparatus includes an image bearing member configured to bear a non-fixed toner image, a transfer portion configured to form a transfer nip together with the image bearing member and to transfer the non-fixed toner image borne on the image bearing member to a sheet at the transfer nip, a fixing portion including a first rotary member, a second rotary member forming a fixing nip together with the first rotary member and a heating portion configured to heat the first rotary member, the fixing portion being configured to fix the non-fixed toner image which has been transferred onto the sheet to the sheet as a fixed toner image by heat and pressure at the fixing nip, a re-conveyance portion configured to convey the sheet that has passed through the fixing portion toward the fixing portion again, a control portion configured to execute a nip image forming process of forming a nip image, on the sheet, corresponding to a shape of the fixing nip by stopping a conveyance of the sheet being conveyed by the fixing portion in a state in which the fixed toner image formed on the sheet is nipped by the fixing nip, and a reading unit configured to read the nip image, wherein the control portion stops the conveyance of the sheet being conveyed by the fixing nip and the transfer nip in a state in which the sheet is not in contact with a part of the first rotary member other than the fixing nip in the nip image forming process.

According to a third aspect of the present invention, an image forming apparatus includes an image forming unit including an image bearing member configured to bear a non-fixed toner image, a transfer portion configured to form a transfer nip together with the image bearing member and to transfer the non-fixed toner image borne onto the image bearing member to a sheet at the transfer nip, and a storage portion configured to store toners of a plurality of colors, a fixing portion including a first rotary member, a second rotary member forming a fixing nip together with the first rotary member, and a heating portion configured to heat the first rotary member, the fixing portion being configured to fix the non-fixed toner image which has been transferred onto the sheet to the sheet as a fixed toner image by heat and pressure at the fixing nip, and a control portion configured to execute an inspection mode of preparing a measurement sheet used to measure a shape of the fixing nip, wherein the control portion executes, in the inspection mode, an inspection image forming process of transferring and fixing an inspection image formed by laminating a plurality of toner layers onto the sheet, and a nip image forming process of forming a nip image corresponding to the shape of the fixing nip by stopping a conveyance of the sheet being conveyed by the fixing portion in a state in which the inspection image is nipped by the fixing nip, wherein the plurality of toner layers transferred onto the sheet by the transfer portion includes a first toner layer which is an uppermost layer formed by a first color toner, and a second toner layer formed adjacent to the first toner layer and formed by a second color toner different from the first color, and wherein the first color is a chromatic color.

Further features of the present invention will become apparent from the following description of exemplary embodiments with reference to the attached drawings.

DESCRIPTION OF THE EMBODIMENTS

First Exemplary Embodiment

Overall Configuration

Figure 1:
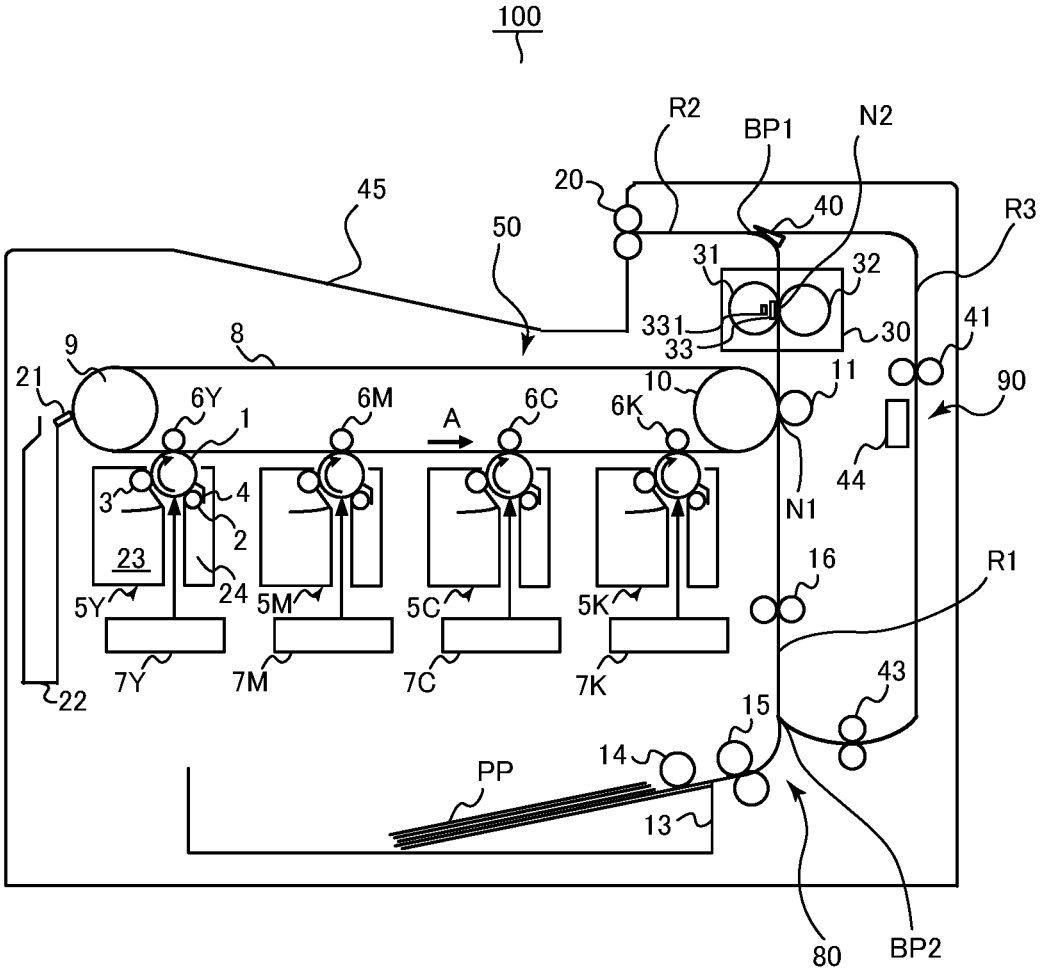
FIG. 1 is a schematic diagram illustrating an overall configuration of a printer according to a first exemplary embodiment.

Firstly, a first exemplary embodiment of the present disclosure will be described. A printer 100 serving as an image forming apparatus of the present disclosure is a full-color laser beam printer of an electro-photographic type. As illustrated in FIG. 1, the printer 100 includes an image forming unit 50 configured to form an image on a sheet PP, a feed portion 80, a discharge roller pair 20 and a re-conveyance portion 90. The image forming unit 50 includes four process cartridges 5Y, 5M, 5C and 5K of yellow (Y), magenta (M), cyan (C) and black (K), scanner units 7Y, 7M, 7C and 7K and a fixing unit 30. The scanner units 7Y, 7M, 7C are polygon scanners using laser diodes.

Note that the four process cartridges 5Y, 5M, 5C and 5K have the same configuration except of colors of images to be formed. Therefore, only the configuration and an image forming process of the process cartridge 5Y will be described below and no description will be made on the other process cartridges 5M, 5C and 5K.

The process cartridge 5Y includes a photosensitive drum 1, a waste toner container 24 accommodating a charging roller 2 and a cleaning blade 4 and a toner container 23 accommodating a developing roller 3. The photosensitive drum 1 is constructed by applying an organic photoconductive layer on an outer circumference of an aluminum cylinder and is rotated by a driving motor not illustrated. Toner within the toner container 23 is negatively charged non-magnetic single-component toner.

The image forming unit 50 is also provided with an intermediate transfer belt 8 wound around a driving roller 9 and a secondary transfer counter roller 10. Provided inside of the intermediate transfer belt 8 are primary transfer rollers 6Y, 6M, 6C and 6K. A cleaning blade 21 configured to scrape toner left on the intermediate transfer belt 8 is provided in a vicinity of the driving roller 9. The toner scraped by the cleaning blade 21 is collected into a waste toner container 22. Still further, provided so as to nip the intermediate transfer belt 8 and to face the secondary transfer counter roller 10 is a secondary transfer roller 11 serving as a transfer portion. The intermediate transfer belt 8 and the secondary transfer roller 11 form a transfer nip N1 for transferring an image onto the sheet PP conveyed thereto. The fixing unit 30 will be described later.

The feed portion 80 is provided at an under part of the printer 100 and includes a cassette 13 supporting the sheet PP and a pickup roller 14 configured to feed the sheet PP supported by the cassette 13. The feed portion 80 also includes a separation roller pair 15 that separates the sheet PP fed by the pickup roller 14 one by one.

Here, each conveyance path and component elements for conveying the sheet provided in the printer 100 will be described. The printer 100 includes a feed conveyance path R1, a discharge conveyance path R2 branched at a branch point BP1 which is a downstream end in the sheet conveyance direction of the feed conveyance path R1 and a duplex conveyance path R3 that extends from the branch point BP1 and merges with the feed conveyance path R1 at a merge point BP2.

A registration roller pair 16 is provided along the feed conveyance path R1. Provided at the branch point BP1 is a guide member 40 configured to guide the sheet PP sent from the feed conveyance path R1 to the discharge conveyance path R2 and to guide the sheet PP sent from the discharge conveyance path R2 to the duplex conveyance path R3.

Provided along the discharge conveyance path R2 is a discharge roller pair 20 configured to rotate normally/reversely and to switch back and to reversely convey the sheet PP. Conveyance roller pairs 41 and 43 configured to convey the sheet PP are provided along the duplex conveyance path R3 and constitute the re-conveyance portion 90 that conveys the sheet PP that has passed through the fixing unit 30 toward the fixing unit 30 again.

A reading unit 44 is provided between the conveyance roller pairs 41 and 43 at a position along the duplex conveyance path R3, serving as a re-conveyance path, and in the sheet conveyance direction. The reading unit 44 includes a light emitter and a Contact Image Sensor (CIS) not illustrated and is configured to be able to read a whole range in a width direction of the sheet PP. The reading unit 44 starts to read the image formed on the sheet PP at timing when the sheet PP passes through the conveyance roller pair 41. The reading unit 44 also photoelectrically reads the image of the sheet PP being conveyed as a time series digital image signal and stores as scan image data in a memory within the reading unit 44. Note that a CMOS sensor or a CCD sensor is also applicable instead of the CIS.

Next, an image forming operation of the printer 100 constructed as described above will be described. When an image signal is inputted from a personal computer or the like not illustrated to the scanner unit 7Y, a laser beam corresponding to the image signal is irradiated from the scanner unit 7Y on the photosensitive drum 1 of the process cartridge 5Y.

At this time, a surface of the photosensitive drum 1 has been homogeneously charged in advance with a predetermined polarity and potential by the charging roller 2, and an electrostatic latent image is formed on the surface of the photosensitive drum 1 by the laser beam irradiated from the scanner unit 7Y The electrostatic latent image formed on the photosensitive drum 1 is developed by the developing roller 3, and a toner image of yellow (Y) is formed on the photosensitive drum 1.

Laser beams are irradiated in the same manner from the scanner units 7M, 7C and 7K to the respective photosensitive drums of the process cartridges 5M, 5C and 5K, and toner images of magenta (M), cyan (C) and black (K) are formed on the respective photosensitive drums. The toner images of the respective colors formed on the respective photosensitive drums are transferred onto the intermediate transfer belt 8 by the primary transfer rollers 6Y, 6M, 6C and 6K and are conveyed to the transfer nip N1 by the intermediate transfer belt 8 rotated by the driving roller 9 in a direction of an arrow A. That is, the intermediate transfer belt 8 serving as an image bearing member bears the non-fixed toner image. Note that the image forming process of each color is performed at a timing of superimposing on an upstream toner image primarily transferred on the intermediate transfer belt 8. Still further, toner left on the photosensitive drum 1 after the transfer of the toner image is collected by the cleaning blade 4.

In parallel with this image forming process, the sheet PP stored in the cassette 13 of the feed portion 80 is delivered by the pickup roller 14 and is separated one by one by the separation roller pair 15. Then, a skew of the sheet PP is corrected by the registration roller pair 16 and the sheet PP is conveyed with a predetermined conveyance timing matching with an image transfer timing at the transfer nip N1.

The full-color non-fixed toner image on the intermediate transfer belt 8 is transferred onto the sheet PP at the transfer nip N1 by a secondary transfer bias applied to the secondary transfer roller 11. Predetermined heat and pressure are applied by the fixing unit 30 to the sheet PP, onto which the non-fixed toner image has been transferred, to melt and fix the non-fixed toner image as a fixed toner image. The sheet PP that has passed through the fixing unit 30 is guided by the guide member 40 to the discharge conveyance path R2 to be discharged onto the discharge tray 45 by the discharge roller pair 20.

When a duplex printing job of forming images on both surfaces of a sheet is inputted, the sheet PP in which the image has been formed on a first surface thereof and has passed through the fixing unit 30 is guided by the guide member 40 to the discharge conveyance path R2. The sheet PP that has been guided to the discharge conveyance path R2 is conveyed toward outside of the apparatus at first by the discharge roller pair 20. Then, when the trailing edge of the sheet PP passes through the branch point BP1, the discharge roller pair 20 rotates reversely and the sheet PP reversed by the discharge roller pair 20 is conveyed to the duplex conveyance path R3.

The sheet PP is conveyed by the conveyance roller pair 41 and merges with the feed conveyance path R1 at the merge point BP2. An image is formed on a second surface of the sheet PP that has merged with the feed conveyance path R1 in the same manner with the first surface and is discharged out to the discharge tray 45.

Fixing Unit

Figure 2:
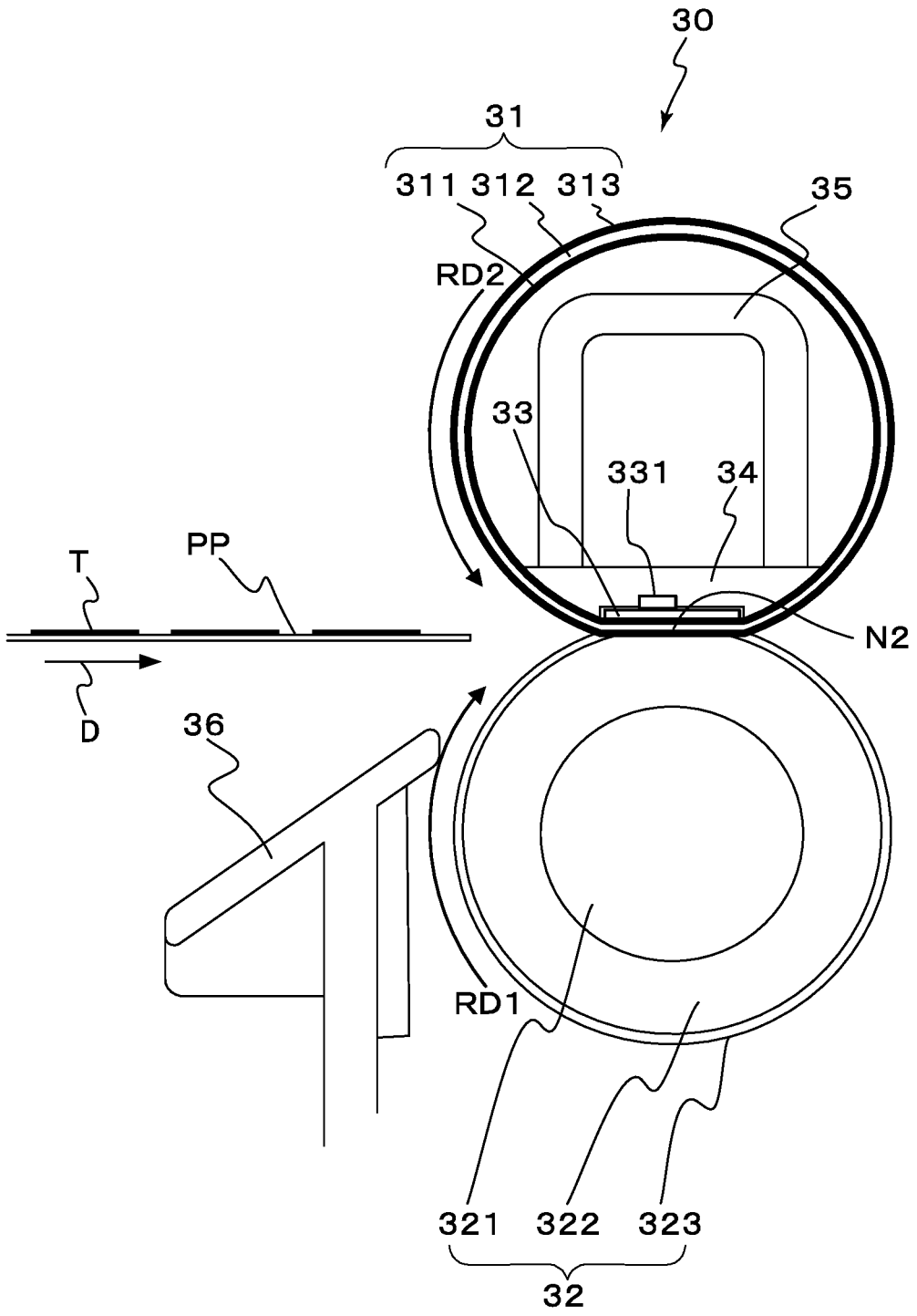
FIG. 2 is a section view illustrating a fixing unit of the first exemplary embodiment.

Next, the fixing unit 30 serving as a fixing portion will be described in detail. FIG. 2 is an enlarged section view illustrating the fixing unit 30, which is represented in a state of being turned clockwise by 90 degrees from the fixing unit 30 in FIG. 1. As illustrated in FIG. 2, the fixing unit 30 includes a fixing film 31 serving as a first rotary member, a pressure roller 32 serving as a second rotary member, a fixing heater 33 serving as a heating portion, a heater holder 34, a pressure stay 35 and an inlet guide 36.

The fixing film 31 is formed of an endless film in which an elastic layer 312 and a surface layer 313 are provided on an outer circumferential surface of a base layer 311. The elastic layer 312 is composed of a heat-resistant elastic material such as silicon rubber for purposes of improving fixability and of homogenizing glossiness. The surface layer 313 is composed of a heat-resistant material having good releasability such as fluororesin for purposes of improving separability from the sheet PP and of suppressing offset of the toner image T.

The pressure roller 32 includes a core axial portion 321, at least one or more layers of elastic layer 322 and a surface layer 323. The elastic layer 322 is composed of a heat-resistant elastic material such as silicon rubber or fluoro rubber to assure the width in the sheet conveyance direction of the fixing nip N2. The surface layer 323 is composed of a heat-resistant material having good releasability such as fluororesin to prevent the surface layer 323 from being contaminated by toner and paper dust.

The fixing heater 33 is a plate-like heating element that rapidly heat the fixing film 31 while being in contact with an inner circumferential surface of the fixing film 31. A thermistor 331 provided on a back surface of a substrate of the fixing heater 33 detects temperature of the fixing heater 33. Then, based on a detection signal of the thermistor 331, electric conduction to an electric heating resistance layer is controlled such that the fixing heater 33 reaches to a predetermined target temperature.

The heater holder 34 holds the fixing heater 33. The pressurizing stay 35 is composed of a stiff material that applies a pressurizing force received from a pressurizing portion not illustrated to the pressure roller 32 via the heater holder 34. A fixing nip N2 is formed between the fixing film 31 and the pressure roller 32 by this pressurizing force.

The pressure roller 32 is rotated in a direction of an arrow RD1 by a fixing motor not illustrated. Then, along with the rotation of the pressure roller 32, the fixing film 31 is driven in a direction of an arrow RD2. The fixing heater 33 rapidly rises its temperature to heat the fixing film 31. In a state in which the fixing heater 33 is controlled to the predetermined target temperature, the sheet PP is guided to the fixing nip N2 along the inlet guide 36 and is nipped and conveyed in the sheet conveyance direction D by the fixing film 31 and the pressure roller 32. Heat and pressure are applied to the sheet PP in the conveyance process to fix the non-fixed toner image T onto the sheet PP.

Control System

Figure 3:
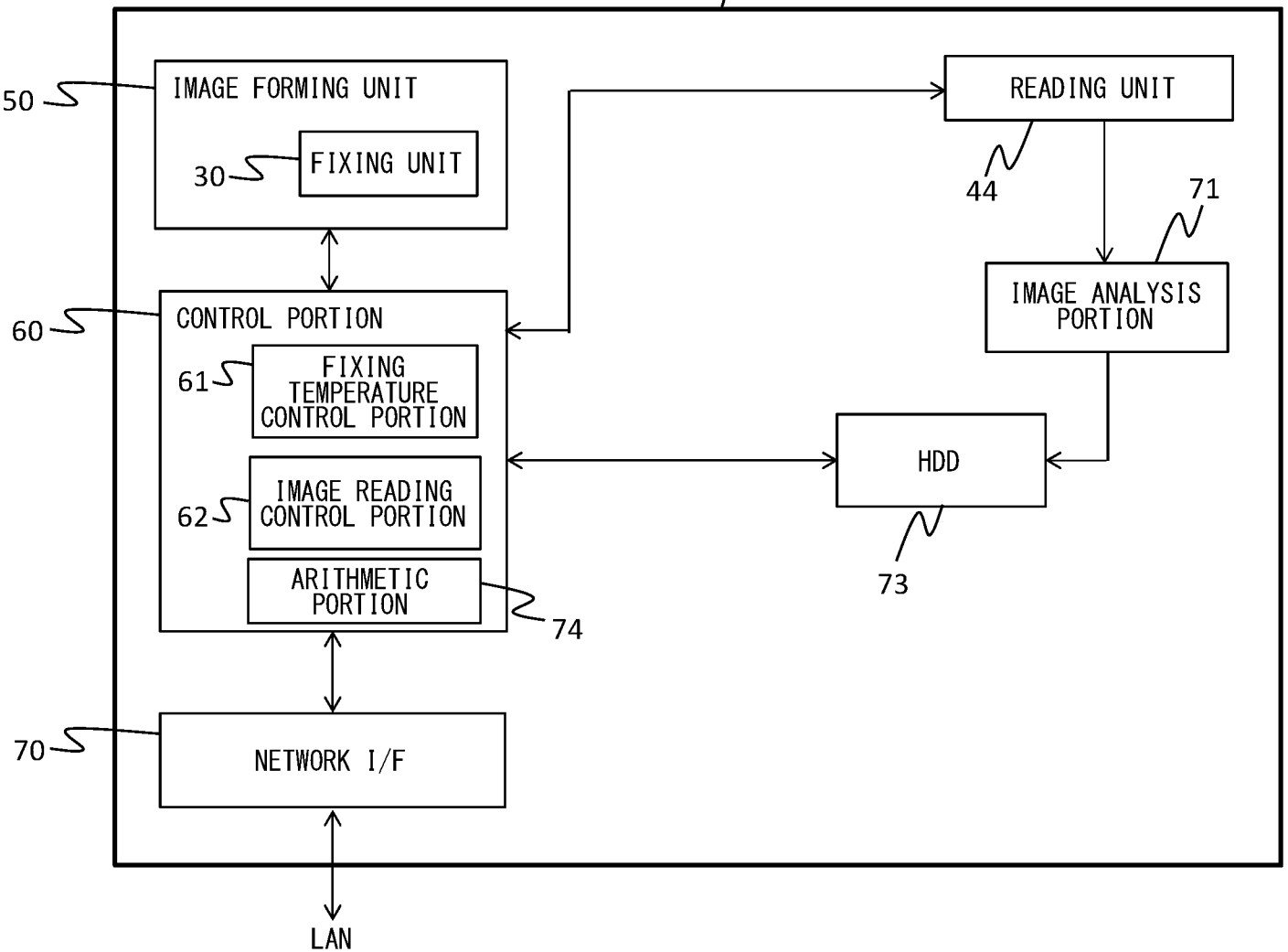
FIG. 3 is a block diagram illustrating a control system of the first exemplary embodiment.

Next, a control system of the printer 100 will be described. As illustrated in FIG. 3, the printer 100 includes a control portion 60 which includes a CPU that controls the entire printer 100, a RAM serving as a work memory and a ROM in which each program is stored. The control portion 60 operates the image forming unit 50 to print an image on the sheet PP based on image information transmitted from a terminal.

The control portion 60 includes a fixing temperature control portion 61, an image reading control portion 62 and an arithmetic portion 74. The fixing temperature control portion 61 controls the temperature of the fixing heater 33 of the fixing unit 30 at a predetermined temperature based on a detection result of the thermistor 331. The image reading control portion 62 issues a read instruction to the reading unit 44 before the sheet PP arrives at the reading unit 44 in scanning an image on the sheet PP to analyze the image as described later.

An image analysis portion 71 analyzes scanned image data accumulated in the reading unit 44, measures a nip width of the fixing nip N2 (referred to as a 'fixing nip width' hereinafter) described later and outputs as analytical result. Note that the image analysis portion 71 may be provided either inside or outside of the control portion 60, and the control portion 60 including the CPU and the image analysis portion 71 constitutes a control portion of the present disclosure.

The printer 100 is also provided with a hard disk drive, i.e., an HDD 73. System software, image data, a measurement result of the nip width of the image analysis portion 71 and a table concerning durability correction described later are stored in the HDD 73. Note that a writable nonvolatile memory such as a semiconductor memory may be used other than the HDD 73.

The arithmetic portion 74 has a function of calculating a durability correction value of the fixing control temperature as a control parameter and determines a durability correction amount of the fixing control temperature from the fixing nip width and a temperature correction amount based on the fixing nip width stored in the HDD 73. The control portion 60 is connected with a LAN via a network I/F 70 and inputs/outputs image information and device information between an external terminal and an image reading apparatus and the printer 100.

Durability Correction of Fixing Temperature

Next, the durability correction of the fixing temperature for the purpose of preventing image defects caused by durability in advance will be described. Along with a drop of durability of the fixing unit 30, the elastic layer 322 of the pressure roller 32 deteriorates and the nip width in the sheet conveyance direction D of the fixing nip N2 is widened. If the fixing nip width is widened, a heat quantity supplied from the fixing film 31 to the sheet PP increases even if the temperature of the fixing heater 33 is kept constant. As a result, an excessive heat quantity is applied to the toner image T in fixing the non-fixed toner image and a part of the toner image T ends up being adhered to the fixing film 31. The toner adhered to the fixing film 31 is fixed onto the sheet PP after one turn of the fixing film 31 and causes such image defect that the image before the one turn is offset (referred to as a 'hot offset' hereinafter).

In order to prevent this hot offset, it is necessary to correct the fixing temperature corresponding to the change of the fixing nip width and to keep the heat quantity supplied to the sheet PP constant. It is then essential to accurately grasp the fixing nip width to that end.

For instance, it is conceivable to correct the fixing temperature by obtaining information on an integrated number of passing sheets of the fixing unit 30 and by presuming the change of the fixing nip width from this integrated number of passing sheets. However, an increase of the fixing nip width changes depending on types of sheets to be passed and on sheet passing conditions. It is because electric power inputted to the fixing unit 30 varies as the type of the sheet and the sheet passing condition are changed and rubber hardness varies as a heat history to the elastic layer 322 of the pressure roller 32 changes. Therefore, a temperature correction amount calculated based on the integrated number of passing sheets may shift from an actually required correction amount, causing image defects caused by the hot offset or by an insufficient heat quantity in contrary.

Then, according to the present exemplary embodiment, the fixing nip width is accurately grasped at all times by executing an automatic measurement mode of automatically measuring the fixing nip width by the reading unit 44 from the nip image formed on the sheet PP. Note that the reading unit 44 may be used also for purposes of adjusting color tone of the toner image to be transferred onto the sheet PP or of detecting image defects by reading the toner image formed on the sheet PP. In particular, according to the present exemplary embodiment, the reading unit 44 can efficiently read the toner image because the reading unit 44 is disposed so as to face a first surface of the sheet PP onto which a non-fixed toner image has been transferred by the transfer nip N1 and which passes through the duplex conveyance path R3 for the first time.

Measurement Pattern

Figure 4:
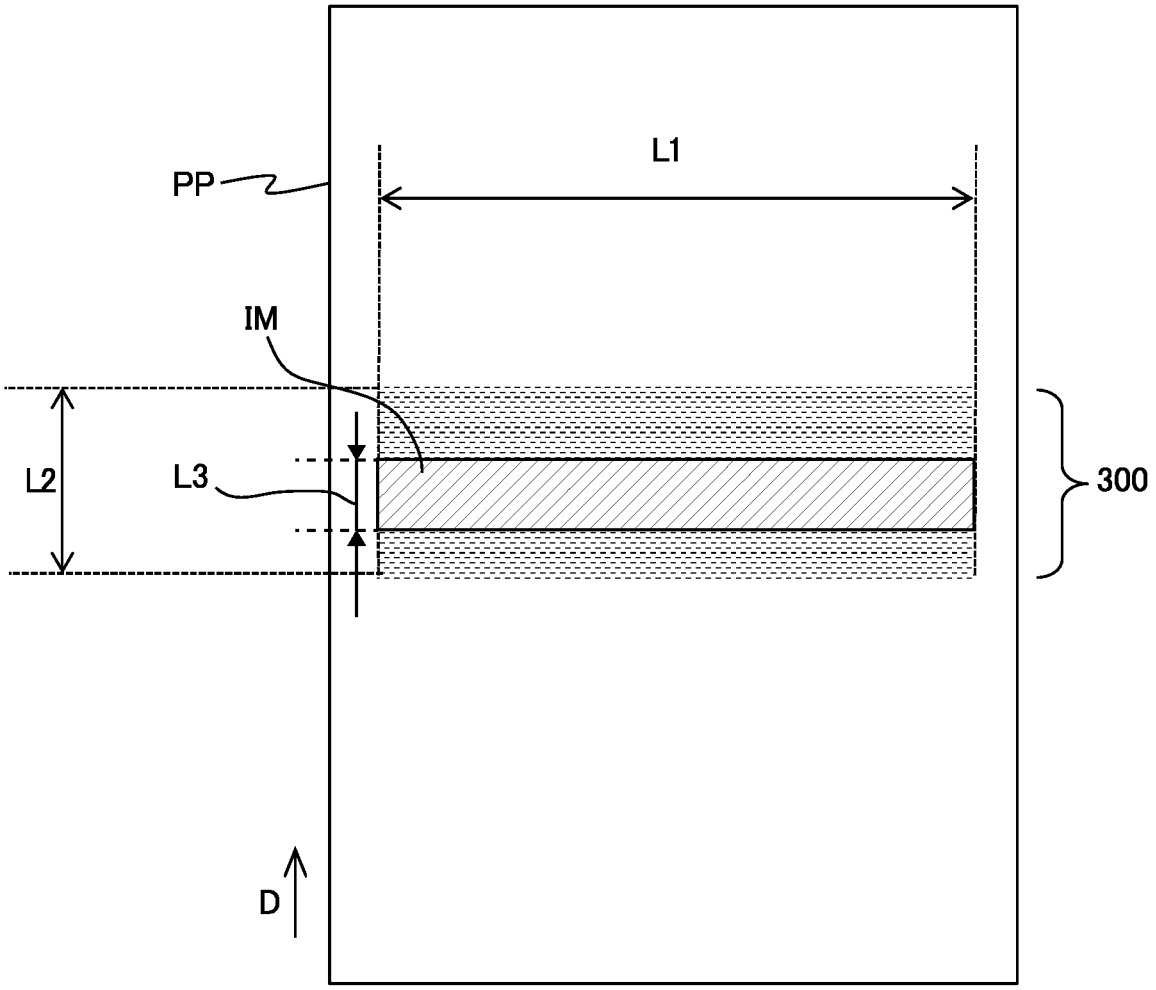
FIG. 4 diagrammatic view illustrating a measurement pattern.

Next, a measurement pattern which is formed on the sheet PP to measure the fixing nip width in the automatic measurement mode will be described. FIG. 4 is a diagrammatic view illustrating a measurement pattern 300. The measurement pattern 300 is a solid image formed of a monochrome toner. A nip image IM corresponding to a shape of the fixing nip N2 is formed within the measurement pattern 300 by Step S3 in FIG. 5 described later. Then, a fixing nip width L3 corresponding to a length in the sheet conveyance direction D of the nip image IM is the fixing nip width.

A size of the sheet PP on which the measurement pattern is printed is an A4-sized sheet for example. The printer 100 of the present exemplary embodiment is an A4-sized apparatus whose printable maximum fixed size is the A4-sized sheet. While it is preferable to set a length L1 in the width direction of the measurement pattern 300 to be a printable maximum width on the A4-sized sheet to be able to analyze the measurement pattern in a wide range, the present disclosure is not limited to such case. Still further, a length L2 in the sheet conveyance direction D of the measurement pattern 300 is naturally greater than the fixing nip width L3, i.e., L2>L3. In the present exemplary embodiment, these lengths are set as L1=200 mm and L2=40 mm, respectively.

Automatic Measurement Mode

Next, operations in the automatic measurement mode will be described with reference to a flowchart in FIG. 5. Note that it is possible to execute the automatic measurement mode by instructing explicitly from an external PC or from an operating portion of the printer 100.

Figure 5:
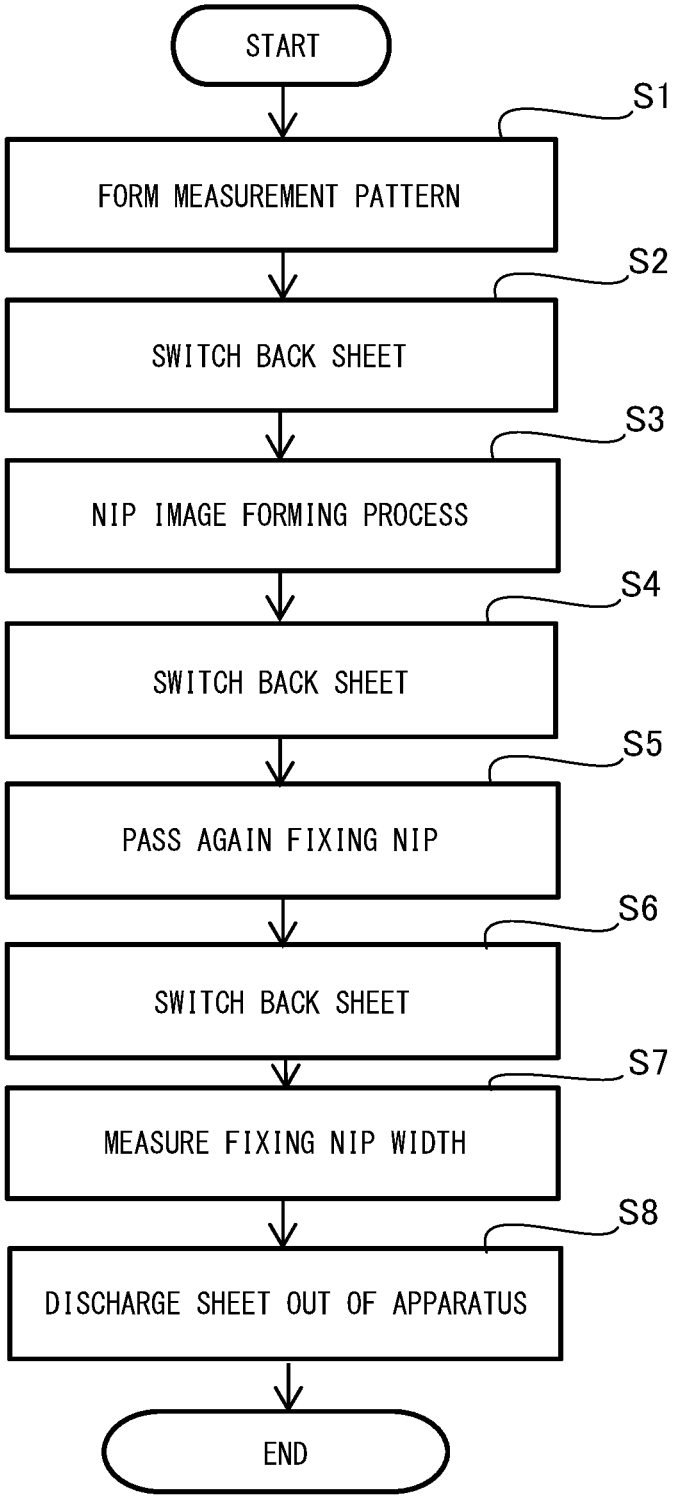
FIG. 5 is a flowchart illustrating operations of an automatic measurement mode.

In executing the automatic measurement mode, the control portion 60 forms the measurement pattern 300 as a fixed image on the sheet PP at first in Step S1 as illustrated in FIG. 5. That is, the control portion 60 transfers the measurement pattern 300 which is a monochromatic solid image formed on the intermediate transfer belt 8 onto the sheet PP at the transfer nip N1 and fixes the measurement pattern 300 to the sheet PP at the fixing nip N2. At this time, a control temperature of the fixing unit 30 is set at 240° C. which is equal to a temperature in normal printing. Note that the control temperature is a target temperature of the fixing heater 33 controlled by the control portion 60.

Next, the control portion 60 conveys the sheet PP to the duplex conveyance path R3 by switching back by the discharge roller pair 20 and conveys the sheet PP again to the fixing unit 30 in Step S2. This operation is performed to cause the surface of the sheet PP on which the measurement pattern 300 has been formed to face the pressure roller 32. It is necessary to form the nip image IM, which is a trace of a nip of the pressure roller 32, on the measurement pattern 300 by bringing the pressure roller 32 in contact with the measurement pattern 300 in order to accurately measure the fixing nip width L3 without resorting the hardness of the pressure roller 32 that varies by durability.

Next, the control portion 60 executes a nip image forming process of forming the nip image IM corresponding to the shape of the fixing nip N2 on the sheet PP by stopping the conveyance of the sheet PP being conveyed by the fixing unit 30 in a state in which the measurement pattern 300 is nipped by the fixing nip N2 in Step S3. A detail of the nip image forming process of Step S3 will be described below.

The control portion 60 causes the sheet PP to enter the fixing unit 30 and stops the conveyance of the sheet PP in the transfer nip N1 and the fixing nip N2 at a timing when an approximate center in the sheet conveyance direction D of the measurement pattern 300 is nipped by the fixing nip N2. At this time, the pressure roller 32 stops in a state of being in contact with the measurement pattern 300 which is a fixed toner image. For instance, the control portion 60 stops a fixing motor configured to drive the pressure roller 32 and a transfer motor configured to drive the driving roller 9. Note that instead of the driving roller 9, the secondary transfer counter roller 10 may be driven by the transfer motor. Still further, the conveyance of the sheet PP in the transfer nip N1 and the fixing nip N2 may be stopped by stopping one driving source, instead of stopping the two driving sources of the fixing motor and the transfer motor.

Then, simultaneously with the stoppage of the conveyance of the sheet PP, the control portion 60 stops supply of electric power to the fixing heater 33. Thereby, the measurement pattern 300 melts again by remaining heat of the fixing film 31 and the pressure roller 32 and a part nipped by the fixing nip N2 is smoothed and becomes the nip image IM. After that, because the supply of electric power to the fixing heater 33 is stopped, temperatures of the fixing film 31 and the pressure roller 32 drop as time elapses and the nip image IM is fixed on the sheet PP in a state in which the smoothness is maintained Thereby, the highly smooth nip image IM corresponding to the shape of the fixing nip N2 is formed on the measurement pattern 300 of the sheet PP.

After that, the control portion 60 supplies electric power to the fixing heater 33 such that the control temperature reaches to 185° C. and then restarts to convey the sheet PP at the transfer nip N1 and the fixing nip N2. Because the measurement pattern 300 is an image that has been already fixed to the sheet PP, it is not necessary to melt the toner of the measurement pattern 300 after restarting the conveyance of the sheet PP at the transfer nip N1 and the fixing nip N2 and the control temperature may be set low. In the present exemplary embodiment, the control temperature is set at 185° C. which is a lowest possible temperature within a range by which lubricant within the fixing unit 30 can be melt such that the fixing unit 30 conveys the sheet PP normally. Silicon oil, fluorine oil, fluorine grease or the like is applicable as the lubricant within the fixing unit 30.

Then, the control portion 60 causes the discharge roller pair 20 to switch back the sheet PP to convey to the duplex conveyance path R3 and to convey again to the fixing unit 30 in Step S4. This operation is performed to reverse the front and back of the sheet PP such that the surface of the sheet PP on which the nip image IM has been formed faces the reading unit 44. The control portion 60 also causes the sheet PP to pass again through the fixing unit 30 to convey the sheet PP to the reading unit 44 in Step S5. Still further, the control portion 60 causes the discharge roller pair 20 to switch back and to convey the sheet PP to the duplex conveyance path R3 in order to convey the sheet PP to the reading unit 44 in Step S6.

The control portion 60 reads the nip image IM formed on the measurement pattern 300 on the sheet PP by the reading unit 44 and measures the fixing nip width L3 in Step S7. The measurement operation of the fixing nip width L3 in Step S7 will be described in detail below.

The measurement pattern 300 of the sheet PP on which the nip image IM has been formed is read by the reading unit 44. Read image data is converted from RGB digital image signal into lightness information. Then, the control portion 60 measures the fixing nip width L3 by assuming locations where the lightness suddenly changes as boundaries in the sheet conveyance direction D of the nip image IM and by calculating a width between the boundaries.

Figure 6A:
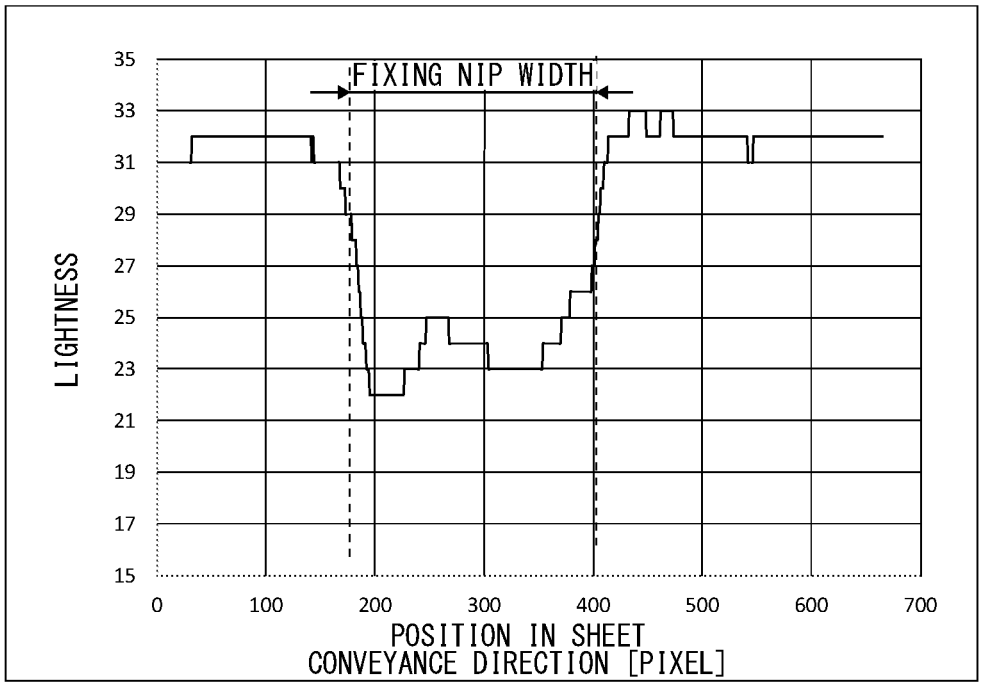
FIG. 6A is a graph indicating lightness of a nip image at each position in a sheet conveyance direction.

FIG. 6A illustrates a distribution of the lightness in the sheet conveyance direction D at a position of a widthwise center part of the nip image IM. An axis of ordinate in FIG. 6A indicates the lightness when the measurement pattern 300 is measured and an axis of abscissa indicates a position in the sheet conveyance direction D. The lightness of an area corresponding to the fixing nip width L3 is lowered as compared to its surrounding area. It is because a scattered light component on the surface of the toner image is reduced by smoothing the toner image in the area of the fixing nip width L3.

Figure 6B:
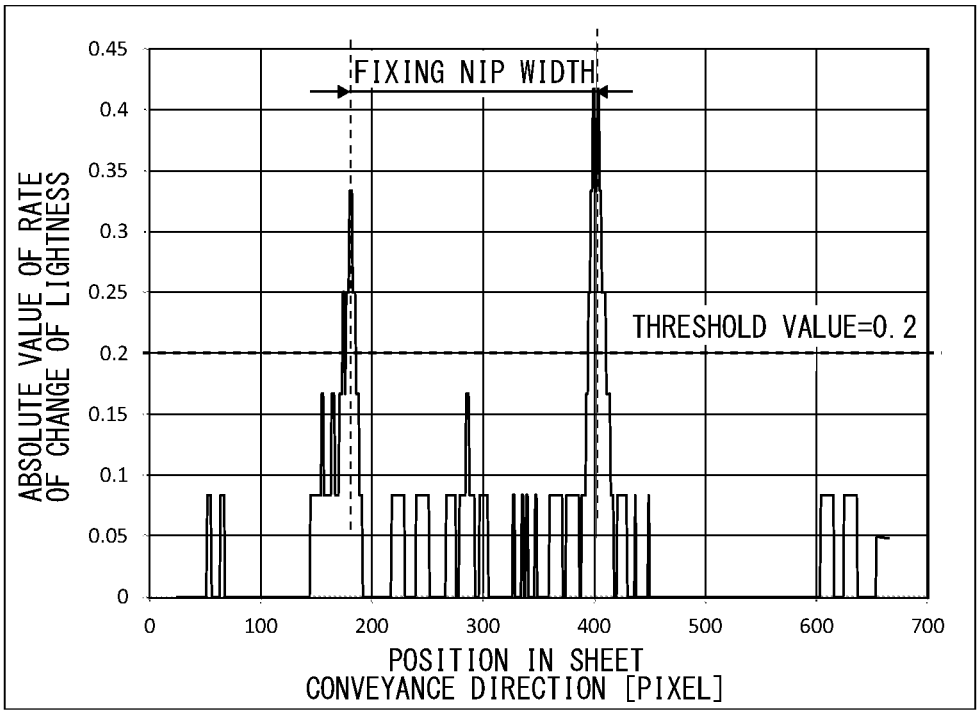
FIG. 6B is a graph indicating a rate of change of the lightness of the nip image at each position in the sheet conveyance direction.

FIG. 6B is a graph indicating absolute values of the lightness illustrated in FIG. 6A by converting the lightness into rate of changes in the sheet conveyance direction D. Here, the rate of change of the lightness in the sheet conveyance direction D is a variation of the lightness per unit distance in the sheet conveyance direction D. Specifically, the variation of the lightness per unit pixel is calculated from the variation of the lightness when moved in the sheet conveyance direction D by 12 pixels, and a value of the variation is indicated as the rate of change in the sheet conveyance direction of the lightness. This arrangement makes it possible to readily detect the boundary positions of the fixing nip width L3 by rendering the lightness by the rate of change.

According to the present exemplary embodiment, positions corresponding to two upper maximum values in an area where the absolute values of the rate of changes exceed a threshold value=0.2 are defined as the boundaries of the fixing nip width L3. Then, by setting a length between these two boundaries as the value of the fixing nip width L3, the control portion 60 obtains a value of the fixing nip width at each position of 37 places which is equally allotted in the width direction of the nip image IM. It is noted that while the threshold value=0.2 in the present exemplary embodiment, the threshold value is not limited to such value.

After finishing the measurement of the fixing nip width L3, the control portion 60 discharges the sheet PP out of the apparatus in Step S8. The control portion 60 obtains the fixing nip width L3 as the width based on the nip image IM in Step S7 and controls the fixing heater 33 based on the fixing nip width L3. Note that the control portion 60 may use the information on the fixing nip width L3 to predict a service life of the fixing unit 30.

In a case where the reading unit 44 is disposed like the present exemplary embodiment, it is necessary to reverse the front and back of the sheet PP to read the nip image IM by the reading unit 44 after forming the nip image IM on the sheet PP as described above. Then, because the sheet PP receives heat at the fixing nip N2 in this process, the boundary of the nip image IM tends to be obscure. If the boundary of the nip image IM becomes obscure, it is unable to accurately measure the fixing nip width L3. Therefore, temperature setting of the fixing unit 30 is important.

Temperature Setting of Fixing Unit

Next, a temperature setting operation of the fixing unit 30 when the sheet PP passes through the fixing nip N2 of the fixing unit 30 in Step S5 in FIG. 5 will be described. According to the present exemplary embodiment, the control temperature Te of the fixing unit 30 in Step S5 is set at 185° C. which is equal to the temperature in forming the nip image IM, i.e., in Step S3 in FIG. 5, and which is lower than 240° C. which is a control temperature in forming the measurement pattern 300 and a normal printing image.

In other words, the control portion 60 sets the fixing heater 33 to 240° C. when the non-fixed toner image passes through the fixing nip N2 as a first temperature. The control portion 60 also sets the fixing heater 33 to 185° C. as a second temperature which is lower than the first temperature, when the nip image IM passes through the fixing nip N2 from when the nip image IM has been formed on the sheet PP until when the nip image IM is read by the reading unit 44.

A reason why the control temperature Te is set thus at the lower temperature will be described below. It is possible to keep the smoothness of the nip image IM by setting the control temperature Te at the relatively lower temperature because the toner composing the measurement pattern 300 is hardly melted again. As a result, the boundary between the nip image IM and the other measurement pattern 300 becomes clear and the fixing nip width L3 can be measured in high precision by keeping a difference between the lightness of the area of the fixing nip width L3 and the lightness of the area other than that high. For comparison, the fixing nip width L3 is read at each setting of Te=210° C. and Te=255° C., besides the control temperature Te=185° C., to confirm the reading accuracy.

The confirmation of the reading accuracy was performed in terms of the fixing nip width at each widthwise position in each control temperature setting by comparing a difference between a value calculated in Step S7 in FIG. 5 and a value measured visually by using a caliper. Here, the value measured by the caliper can be handled as a highly reliable real value because it is measured by adding both of a glossiness difference and a concentration difference. A square of the difference between the value calculated in Step S7 in FIG. 5 and the value measured by the caliper is calculated on the 37 widthwise positions and a degree of a sum of squares S is evaluated as a deviation from the real value of the fixing nip width. The sum of squares S can be derived from the following equation 1:

$$S = \sum_{i=1}^{37} (xi - yi)^2 \tag{1}$$

Here, function xi denotes the fixing nip width at each position calculated in Step S7, function yi is the fixing nip width (real value) at each position measured by the caliper and i is an index corresponding to each widthwise position.

Figure 7:
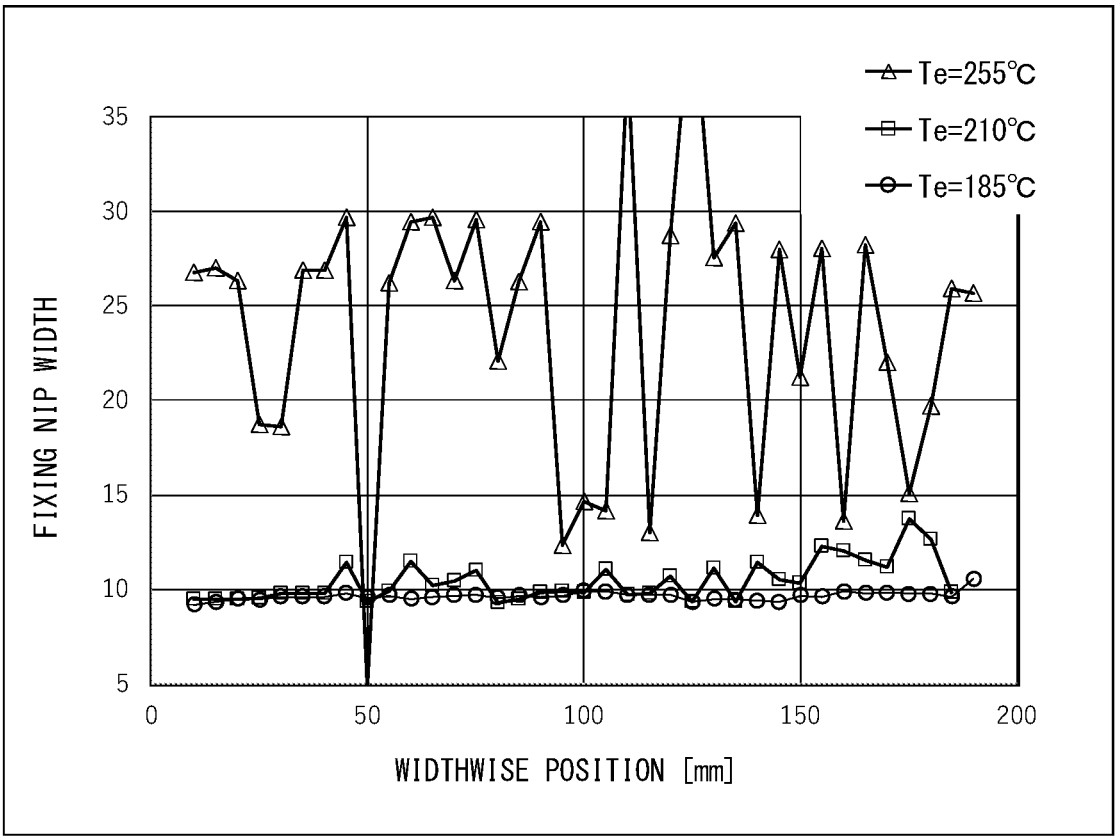
FIG. 7 is a graph indicating a fixing nip width measured at each control temperature.

FIG. 7 is a graph representing a result of the fixing nip width corresponding to the function xi of the equation 1 read by the reading unit 44 and plotted by each control temperature described above. It can be seen from the graph in FIG. 7 that values vary among the respective widthwise positions in the plots of Te=210° C. and Te=255° C. as compared to the plot of Te=185° C.

It means that the smaller the variation, the smaller the sum of squares S is and the smaller the sum of squares S, the more accurately the fixing nip width L3 is measured. The following table indicates the sum of squares S in each control temperature described above:

Table 1:

TABLE 1

| | Te | S |
|---|---|---|
| FIRST EXEMPLARY EMBODIMENT | 185° C. | 2.0 |
| — | 210° C. | 146.5 |
| — | 255° C. | 9693.0 |

As it is apparent from the table described above, the lower the control temperature Te, the smaller the sum of squares S is and the more accurately the fixing nip width L3 can be measured.

As described above, the boundary of the nip image IM is clarified by lowering the control temperature in passing through the fixing nip N2 again, i.e., in Step S5 in FIG. 5, in the printer 100 having the automatic measurement mode. Accordingly, it is possible to improve the accuracy in reading the nip image IM by the reading unit 44. This arrangement makes it possible to measure the fixing nip width L3 in high precision from the nip image IM read by the reading unit 44 and to adequately control the control temperature of the fixing unit 30 corresponding to the fixing nip width L3. Therefore, even if the durability of the fixing unit 30 deteriorates, it is possible to apply an adequate heat quantity to the toner image on the sheet and to obtain high quality products.

Second Exemplary Embodiment

Next, while a second exemplary embodiment of the present disclosure will be described below, the second exemplary embodiment is what only the nip image forming process of the first exemplary embodiment is modified. Therefore, components similar to those of the first exemplary embodiment will be described by denoting the same reference signs or their illustrations will be omitted here.

As a result of investigation on a factor concerning the measurement accuracy of the fixing nip width L3, it was found that a posture of the sheet in the nip image forming process also affects the measurement accuracy. Then, the measurement accuracy of the fixing nip width L3 will be improved by stabilizing the posture of the sheet in the nip image forming process, i.e., in Step S3 in FIG. 5, in the automatic measurement mode in the present exemplary embodiment.

Figure 8:
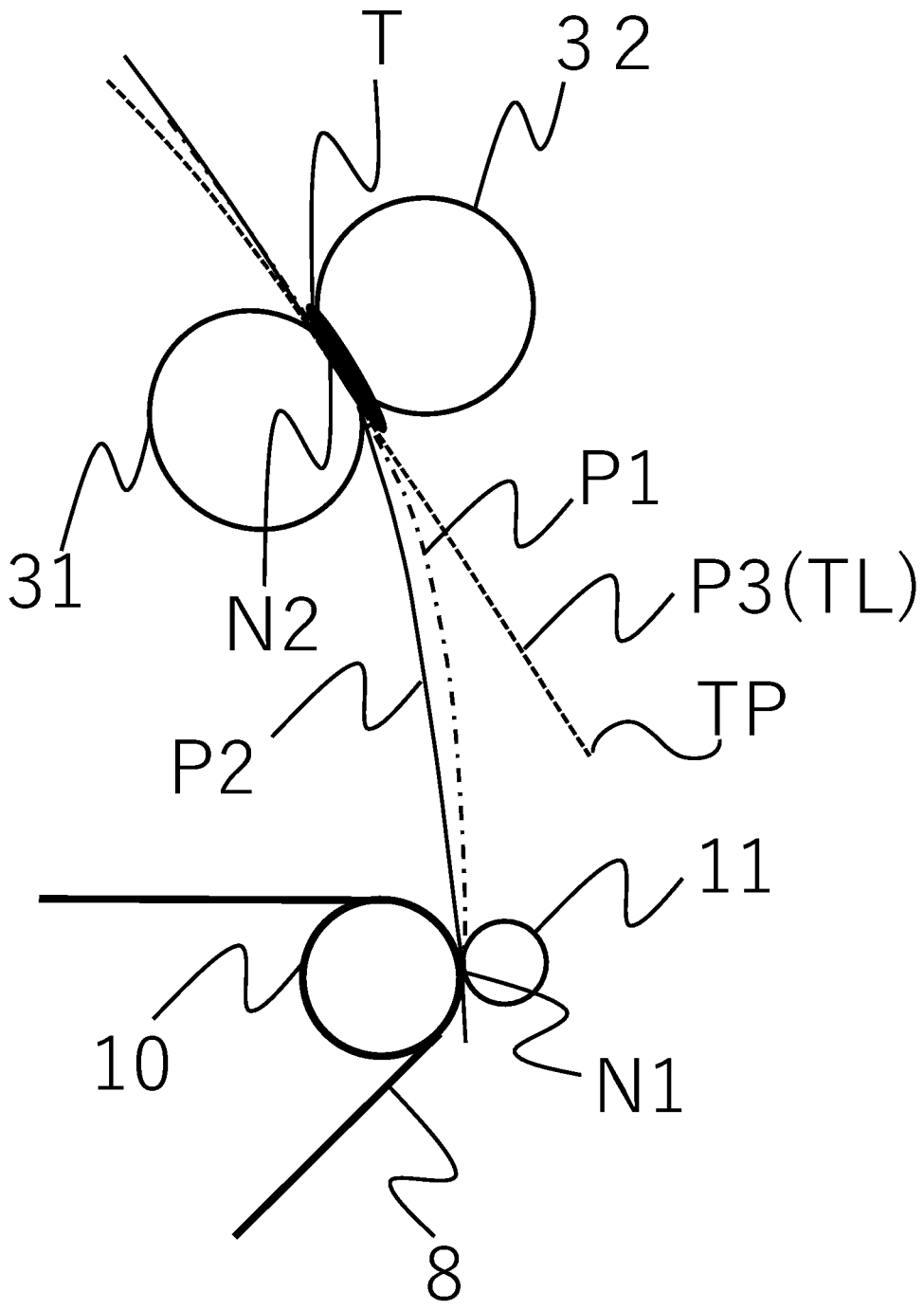
FIG. 8 is a diagrammatic view illustrating a posture of a sheet according to a second exemplary embodiment.

FIG. 8 illustrates the posture of the sheet in the stoppage state in the nip image forming process by postures P1, P2 and P3. The postures P1, P2 and P3 are the posture of the sheet in a state of straddling over the transfer nip N1 and the fixing nip N2. The posture P1 indicates a case where the temperature of the pressure roller 32 is low and the posture P2 indicates a case where the temperature of the pressure roller 32 is high. The posture P3 is a posture of the sheet in a state of being stopped after when a trailing edge of the sheet has passed through the transfer nip N1.

In the case where the temperature of the pressure roller 32 is high, an outer diameter of the pressure roller 32 increases due to thermal expansion of the elastic layer 322 (see FIG. 2) of the pressure roller 32 and a sheet conveyance speed at the fixing nip N2 increases. Meanwhile, a sheet conveyance speed at the transfer nip N1 is always constant. Due to that, a degree of deflection of the sheet conveyed while straddling over the transfer nip N1 and the fixing nip N2 varies by the temperature of the pressure roller 32. The degree of deflection of the sheet when the temperature of the pressure roller 32 is high is lessened as indicated by the posture P2 in FIG. 8 as compared to the posture P1 of the sheet when the temperature of the pressure roller 32 is low.

If the sheet changes its posture so as to approach to the fixing film 31, a contact state of the sheet with the fixing film 31 changes. As a result, heat is transmitted from the back surface of the sheet on which no toner image is formed to the surface of the sheet on which the toner image T has been formed and the toner image T may be slightly melted, there is a possibility that the boundary of the nip image IM becomes unclear. This factor may drop the measurement accuracy of the fixing nip width L3.

Then, according to the present exemplary embodiment, the nip image IM is formed by stopping the conveyance of the sheet and the supply of power to the fixing heater 33 after when the trailing edge TP of the sheet passes through the transfer nip N1 and before the trailing edge TP arrives at the fixing nip N2 as indicated by the posture P3. This arrangement makes it possible to form the nip image IM in a state of separating a part of the sheet, upstream of the fixing nip N2 in the sheet conveyance direction, from the fixing film 31 by utilizing stiffness of the sheet. In other words, the control portion 60 stops the conveyance of the sheet being conveyed by the fixing nip N2 and the transfer nip N1 in a state in which the sheet does not come into contact with parts of the fixing film 31 other than the fixing nip N2 in the nip image forming process.

Note that in the present exemplary embodiment, the transfer nip N1 is located on the same side with the fixing film 31 with respect a tangential line TL of the fixing film 31 and the pressure roller 32 in the fixing nip N2. Due to that, when the trailing edge TP passes through the transfer nip N1, the trailing edge TP moves in a direction of approaching the tangential line TL by the stiffness of the sheet.

Effects of the present exemplary embodiment will be described below based on a verification result. The following table 2 indicates the sum of squares S in each example as the confirmation of the measurement accuracy of the fixing nip width L3 in a first comparative example and the second exemplary embodiment. The temperature measured by the thermistor 331 when the automatic measurement mode is started is 90° C. in the first comparative example and the second exemplary embodiment. Still further, the sheet is stopped in the posture P2 in the nip image forming process in the first comparative example and the sheet is stopped in the posture P3 in the nip image forming process in the second exemplary embodiment:

Table 2:

TABLE 2

| | POSTURE OF SHEET | TEMPERATURE OF THERMISTOR IN STARTING AUTOMATIC MEASUREMENT MODE | S |
|---|---|---|---|
| FIRST COMPARATIVE EXAMPLE | P2 | 90° C. | 146.5 |
| SECOND EXEMPLARY EMBODIMENT | P3 | 90° C. | 2.1 |

It is noted that while the present exemplary embodiment has been described by exemplifying the transfer nip N1 formed of the secondary transfer counter roller 10 and the secondary transfer roller 11 in the full-color printer 100, the present disclosure is not limited to that. For instance, a nip image IM may be formed by stopping a sheet after when a trailing edge of the sheet passes through a nip formed of a photosensitive member and a transfer roller in a monochrome printer.

Third Exemplary Embodiment

Next, while a third exemplary embodiment of the present disclosure will be described, the third exemplary embodiment is what only the nip image forming process of the second exemplary embodiment is modified. Therefore, components similar to those of the first exemplary embodiment will be described by denoting the same reference signs or their illustrations will be omitted here.

Figure 9:
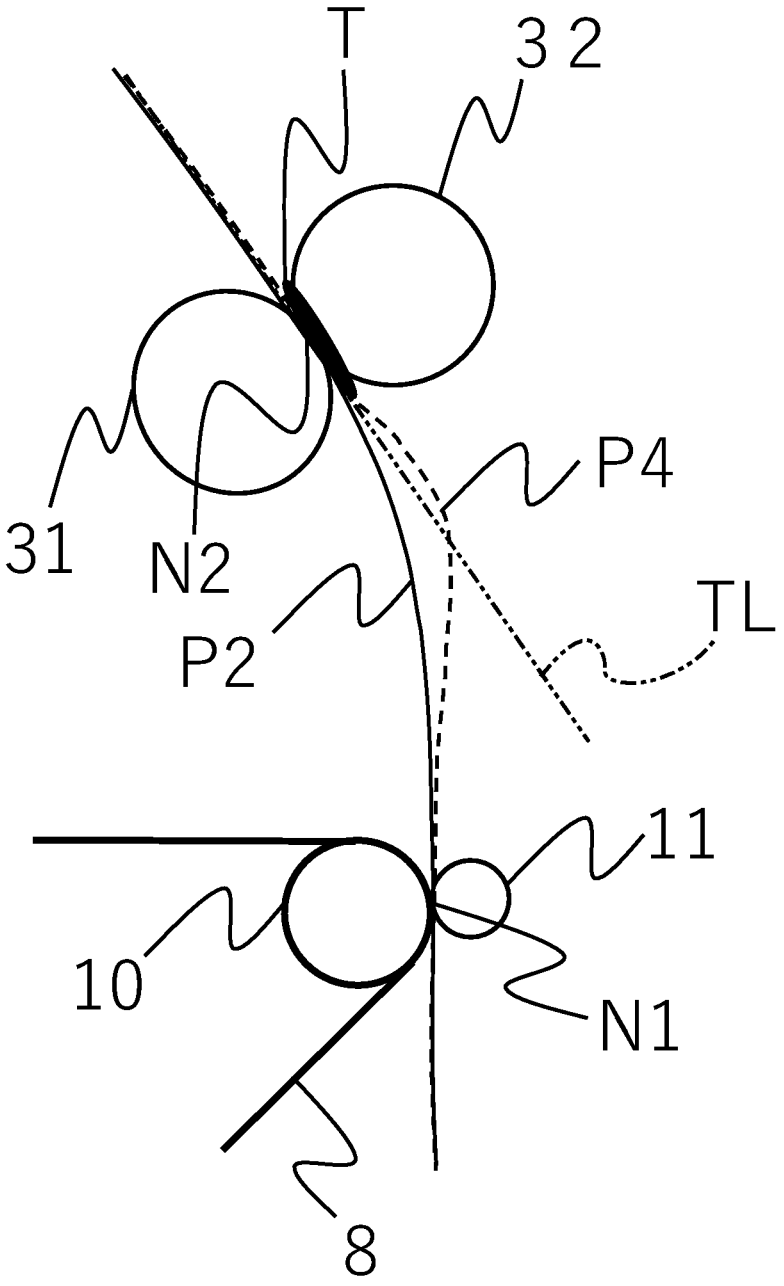
FIG. 9 is a diagrammatic view illustrating a posture of a sheet according to a third exemplary embodiment.

FIG. 9 indicates the posture of the sheet in the stoppage state in the nip image forming process by the postures P2 and P4. The posture P4 is a posture of the sheet straddling over the fixing nip N2 and the transfer nip N1 and deflecting more than the posture P2.

According to the present exemplary embodiment, the conveyance of the sheet by the transfer nip N1 is stopped after stopping the conveyance of the sheet being conveyed by the fixing nip N2 in a state in which the sheet is nipped by the transfer nip N1 and the fixing nip N2. This arrangement makes it possible to form the nip image IM in a state in which a part of the sheet upstream the fixing nip N2 is separated from the fixing film 31. In other words, the control portion 60 stops the conveyance of the sheet being conveyed by the fixing nip N2 and the transfer nip N1 in a state in which the sheet does not come into contact with a part of the fixing film 31 other than the fixing nip N2 in the nip image forming process.

Note that in the present exemplary embodiment, the transfer nip N1 is located on the same side with the fixing film 31 with respect to the tangential line TL of the fixing film 31 and to the pressure roller 32 in the fixing nip N2. Due to that, if the conveyance of the sheet by the transfer nip N1 is stopped after stopping the conveyance of the sheet being conveyed by the fixing nip N2, the sheet deflects in a direction of separating from the fixing film 31.

Effects of the present exemplary embodiment will be described below based on a verification result. The following table 2 indicates the sum of squares S in each example as confirmation of the measurement accuracy of the fixing nip width L3 in a first comparative example and the third exemplary embodiment. The temperature measured by the thermistor 331 when the automatic measurement mode is started is 90° C. in the first comparative example and the third exemplary embodiment. Still further, the sheet is stopped in the posture P2 in the nip image forming process in the first comparative example and the sheet is stopped in the posture P4 in the nip image forming process in the third exemplary embodiment:

Table 3:

TABLE 3

| | POSTURE OF SHEET | TEMPERATURE OF THERMISTOR IN STARTING AUTOMATIC MEASUREMENT MODE | S |
|---|---|---|---|
| FIRST COMPARATIVE EXAMPLE | P2 | 90° C. | 146.5 |
| THIRD EXEMPLARY EMBODIMENT | P4 | 90° C. | 1.9 |

Because the fixing unit 30 has been warmed up in starting the automatic measurement mode in the first comparative example, the sum of squares S increases and a deviation from the real value increases. Meanwhile, it is possible to keep away the sheet from the fixing film 31 on outside of the fixing nip N2 by stopping the sheet in the posture P4 by which the deflection larger than that of the posture P2 is formed like the third exemplary embodiment. Therefore, even if the fixing unit 30 has been warmed up, it is possible to suppress the influence of the heat from the fixing film 31, to form the nip image IM having a clear boundary and to suppress the deviation from the real value. Accordingly, it is possible to improve the nip image reading accuracy of the reading unit 44.

Fourth Exemplary Embodiment

Next, while a fourth exemplary embodiment of the present disclosure will be described below, components similar to those of the first exemplary embodiment will be described by denoting the same reference signs or their illustrations will be omitted here.

Figure 10:
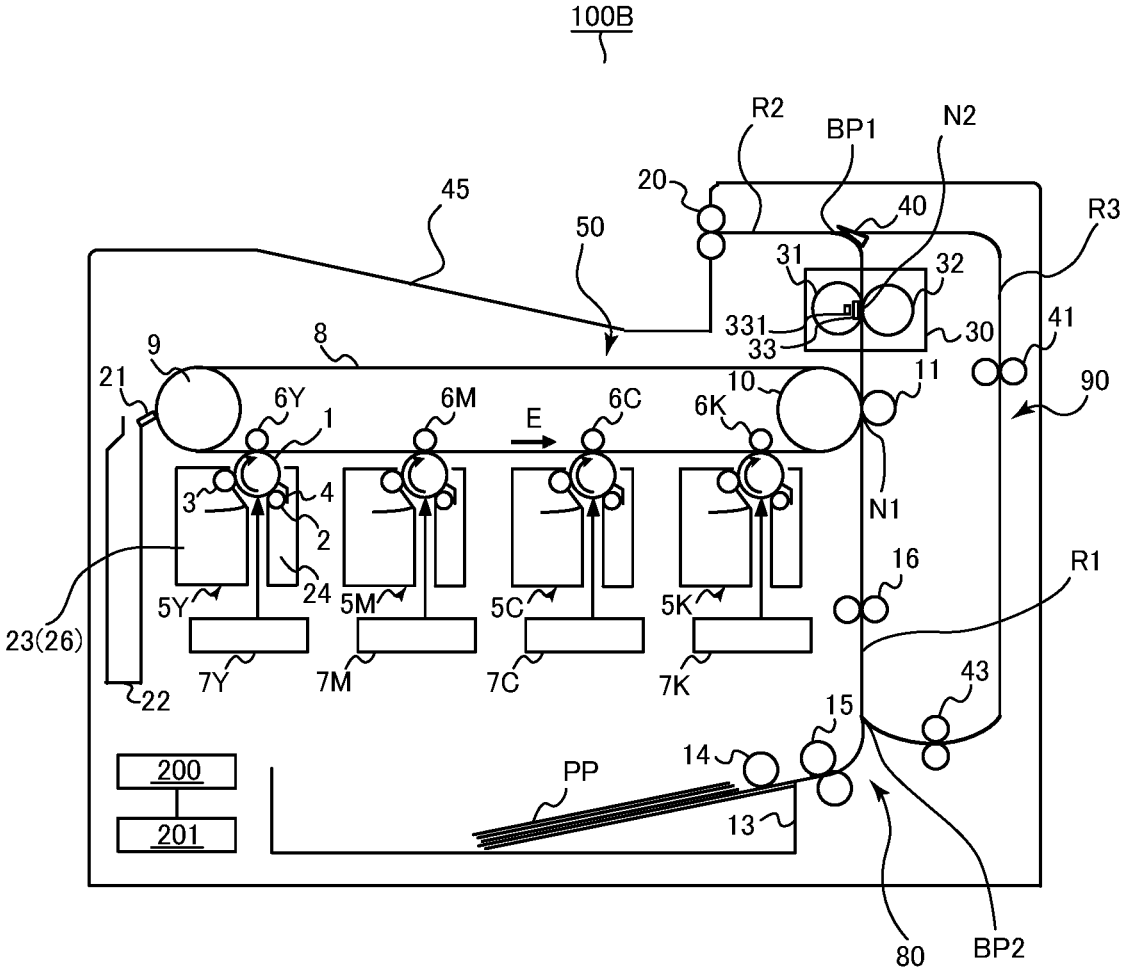
FIG. 10 is a schematic diagram illustrating an overall configuration of a printer of a fourth exemplary embodiment.

FIG. 10 is a schematic diagram illustrating an overall configuration of a printer 100B serving as an image forming apparatus of the fourth exemplary embodiment. Only components of the printer 100B different from those of the printer 100 illustrated in FIG. 1 will be described below. As illustrated in FIG. 10, the printer 100B includes the image forming unit 50 configured to form an image on a sheet PP, the fixing unit 30, the feed portion 80, the discharge roller pair 20 and the re-conveyance portion 90. The printer 100B also includes a control portion 200 configured to control the printer 100B and a video controller 201 configured to form an image signal for forming the image.

The image forming unit 50 includes a storage portion 26 configured to store a plurality of color toners. According to the present exemplary embodiment, the storage portion 26 is composed of a toner container 23 of each process cartridge configured to store the toner of four colors of yellow (Y), magenta (M), cyan (C) and black (K), respectively. Still further, in a case where a toner bottle that is removable from a printer body is provided, besides the process cartridge, the storage portion 26 may be composed of the toner bottle. The printer 100B of the present exemplary embodiment is not provided with the reading unit 44 described in the first exemplary embodiment.

It is noted that a maximum sheet passing width of the printer 100B is A4 size and an A4-sized sheet PP is conveyed in a longitudinal direction to print 40 pages per minute in the present exemplary embodiment. A conveyance speed of the sheet PP within the printer 100B is 240 mm/s.

Figure 11:
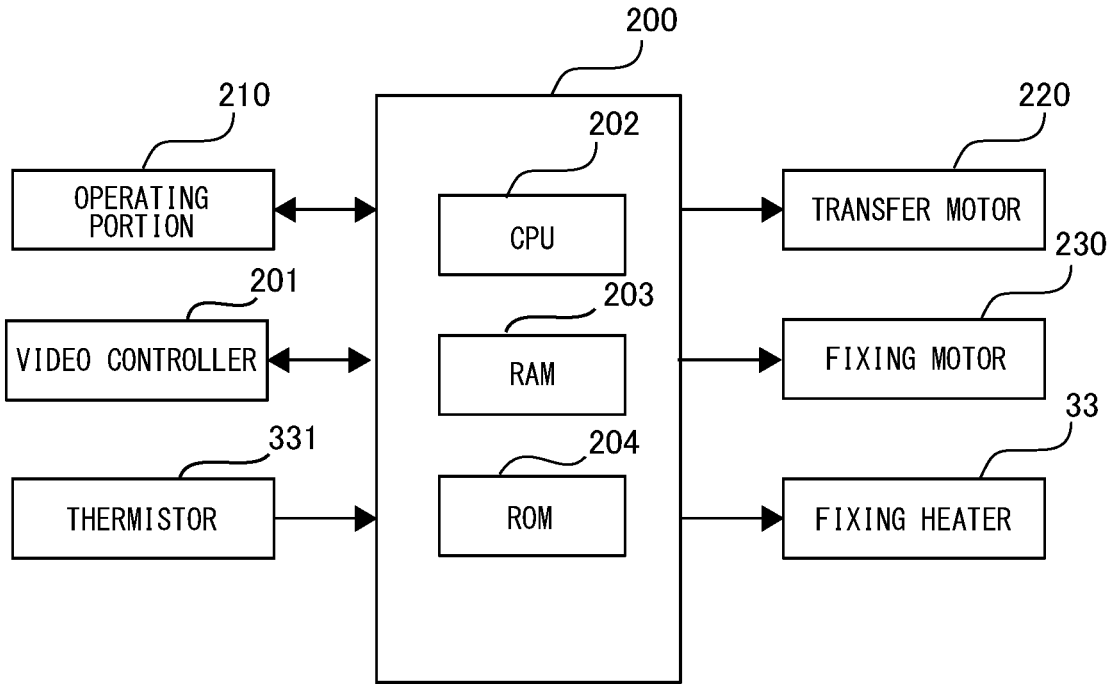
FIG. 11 is a block diagram illustrating a control system of the fourth exemplary embodiment.

The fixing unit 30 of the present exemplary embodiment is the same with the fixing unit described in FIG. 2. A target temperature Ttg of the fixing heater is set at 200° C. A width in the sheet conveyance direction D of the fixing nip N2 is set at 8±1 mm for example Control System Next, a control system of the printer 100B will be described. As illustrated in FIG. 11, the printer 100B includes a control portion 200 which includes a CPU 202 that controls the entire printer 100B, a RAM 203 serving as a work memory and a ROM 204 in which each program is stored. An image forming control sequence for forming an image on a sheet and a measurement sequence for measuring the fixing nip N2 of the fixing unit 30 are stored in the ROM 204. An inspection image or the like to be formed on the measurement sheet is also stored in the ROM 204.

The control portion 200 is connected with an operating portion 210 and the video controller 201. The operating portion 210 includes physicals buttons and a liquid crystal screen for making various settings, and the user can input various information such as attributes of a sheet to be used through the operating portion 210. The video controller 201 is configured to transmit, as it receives image data from an external device such as a host computer, a print signal to the control portion 200 and to convert the received image data into bit map data.

The thermistor 331 is also connect to an input side of the control portion 200. An output side of the control portion 200 is connected with a transfer motor 220, a fixing motor 230 and the fixing heater 33. Temperature of the fixing heater 33 is controlled to be a predetermined target temperature based on a detection result of the thermistor 331.

The transfer motor 220 drives the driving roller 9 and can convey the sheet PP at the transfer nip N1 by driving the driving roller 9. The fixing motor 230 drives the pressure roller 32 and can convey the sheet PP at the fixing nip N2 by driving the pressure roller 32.

It is noted that the secondary transfer counter roller 10, not the driving roller 9, may be driven by the transfer motor 220. Still further, the conveyance of the sheet at the transfer nip N1 and the fixing nip N2 may be controlled by one driving source, not the two driving sources of the transfer motor 220 and the fixing motor 230.

As described in the first exemplary embodiment, it is necessary to keep the supply of the heat quantity to the sheet PP constant by correcting a fixing temperature corresponding to the variation of the fixing nip width to prevent the hot offset. To that end, it is important to accurately grasp the fixing nip width.

Then, according to the fourth exemplary embodiment, an inspection mode of preparing a measurement sheet used to measure the shape of the fixing nip N2 is executed. A nip image corresponding to the shape of the fixing nip N2 is formed on the measurement sheet, and the user can measure the fixing nip width L3 (see FIG. 13) which is a width in the sheet conveyance direction D of the fixing nip N2 from the nip image by using a caliper or the like. It is possible to execute the inspection mode by explicitly instructing from the external device such as the host computer and the operating portion 210 of the printer 100B.

Inspection Mode

Next, operations of the inspection mode will be described with reference to a flowchart in FIG. 12. As the inspection mode starts, the control portion 200 feeds the sheet PP within the cassette 13 by the feed portion 80 in Step S11. Next, the control portion 200 forms an inspection image 400 (see FIG. 13) stored in the ROM 204 on a sheet as a non-fixed toner image similarly to the image forming operation of the printer 100B described above in Step S12.

Next, the control portion 200 fixes the non-fixed inspection image 400 to the sheet by the fixing unit 30 in Step S13. These Steps S12 and S13 compose an inspection image forming process of transferring and fixing the inspection image 400 onto the sheet. Then, the control portion 200 conveys the sheet to the duplex conveyance path R3 and merges with the feed conveyance path R1 similarly to the duplex printing process in Steps S14 and S15. It is noted that because the front and back of the sheet are reversed in passing through the duplex conveyance path R3, the inspection image faces the pressure roller 32 in passing through the feed conveyance path R1.

Next, the control portion 200 re-introduces the sheet to the fixing nip N2 in Step S16. It is noted that when the sheet passes through the feed conveyance path R1, even though the intermediate transfer belt 8 and the secondary transfer roller 11 are rotated to convey the sheet, no bias is applied to the secondary transfer roller 11. Still further, even though the photosensitive drum 1 rotates together with the charging roller 2 while being charged by the charging roller 2 along with the rotation of the intermediate transfer belt 8, the developing roller 3 only rotates while being applied with no bias. No exposure of the photosensitive drum 1 by the scanner unit 7Y is performed. Accordingly, no toner image is formed on the sheet. As for these rotational operations, the same applies not only to the process cartridge 5Y but also to the process cartridges 5M, 5C and 5K.

Note that the image forming unit 50 may be provided with a separation mechanism to separate the photosensitive drum 1 from the intermediate transfer belt 8 by the separation mechanism to stop the rotations of the photosensitive drum 1, the charging roller 2 and the developing roller 3 of the process cartridge 5Y.

Next, the control portion 200 forms a nip image IM (see FIG. 13) corresponding to the shape of the fixing nip N2 by stopping the sheet re-introduced into the fixing nip N2 in a state in which the inspection image 400 is nipped by the fixing nip N2 in Step S17. For instance, the control portion 200 temporarily stops the sheet for 30 seconds in the fourth exemplary embodiment. Note that the pressure roller 32 is stopped in a state of being in contact with the inspection image 400. Step S17 composes a nip image forming process.

While electricity to the fixing heater 33 is stopped for a sake of safety at this time, temperatures of the fixing film 31 and the pressure roller 32 have risen by the previous fixing operation and the inspection image 400 is heated by remaining heat at the fixing nip N2. A time during when the sheet PP passes through the fixing nip N2 in forming a normal image of the printer 100B can be found by fixing nip width÷a conveyance speed of the sheet P. In the fourth exemplary embodiment, the fixing nip width is set to be 8 mm and the conveyance speed of the sheet PP is set at 240 mm/s, so that the abovementioned time is 0.033 seconds.

However, because a pause time of the sheet in the inspection mode is remarkably so long as 30 seconds, the inspection image 400 on the sheet can be melt only by the remaining heat of the fixing unit 30. It is noted that while the control portion 200 stops the fixing motor 230 to stop the sheet at the fixing nip N2, all of rollers involved in the conveyance of the sheet are stopped. For instance, if the sheet is nipped also by the transfer nip N1, the transfer nip N1 is also stopped.

After stopping the sheet for a certain time, e.g., 30 seconds, in Step S17, the control portion 200 re-conveys the sheet to discharge onto the discharge tray 45 by the discharge roller pair 20 in Step S18. Thereby, the measurement sheet Pm on which the nip image IM (see FIG. 13) has been formed is formed and the operations of the inspection mode end by that.

Measurement Sheet

Figure 13:
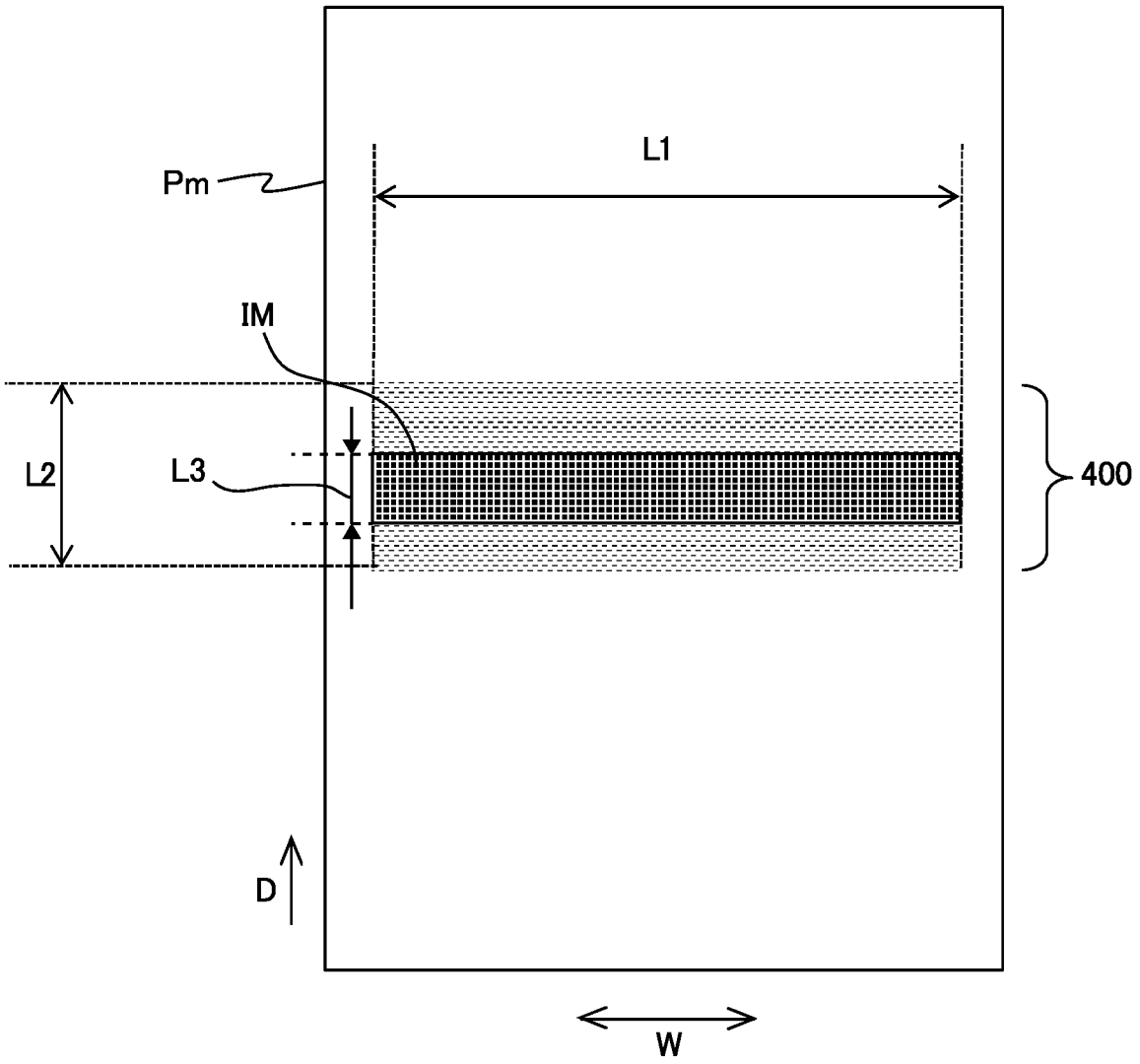
FIG. 13 is a plan view illustrating a measurement sheet.

FIG. 13 illustrates one example of the measurement sheet Pm. The inspection image 400 is formed on the measurement sheet Pm and the nip image IM which is a trace of the fixing nip N2 is formed within the inspection image 400. The nip image IM has a hue different from those of other areas within the inspection image 400.

Size of the sheet PP used as the measurement sheet Pm is an A4-sized sheet in the fourth exemplary embodiment. The A4-sized sheet PP is used to form the inspection image 400 to be long in a width direction W orthogonal to the sheet conveyance direction D because the maximum sheet feeding width of the printer 100B is the A4-size sheet as described above. It is possible to acquire information concerning the fixing nip width in a widthwise wide range by forming the inspection image 400 to be long in the width direction W.

In the present exemplary embodiment, a length L1 in the width direction of the inspection image 400 is set at 200 mm and a length L2 in the sheet conveyance direction D is set at 60 mm. It is noted that sizes of the sheet PP and the inspection image 400 used in the measurement sheet Pm are not limited to them. The inspection image 400 is formed from a position of 118.5 mm from a leading edge of the sheet in the sheet conveyance direction D.

A length L2 of the inspection image 400 is naturally larger than the fixing nip width L3 (L2>L3). The pause timing of the sheet described in Step S17 in FIG. 12 is executed while synchronizing with the conveyance of the sheet such that the inspection image 400 is nipped by the fixing nip N2. Still further, a RedLabel sheet (80 g/m$^2$) is used for the measurement sheet Pm.

Figure 23A:
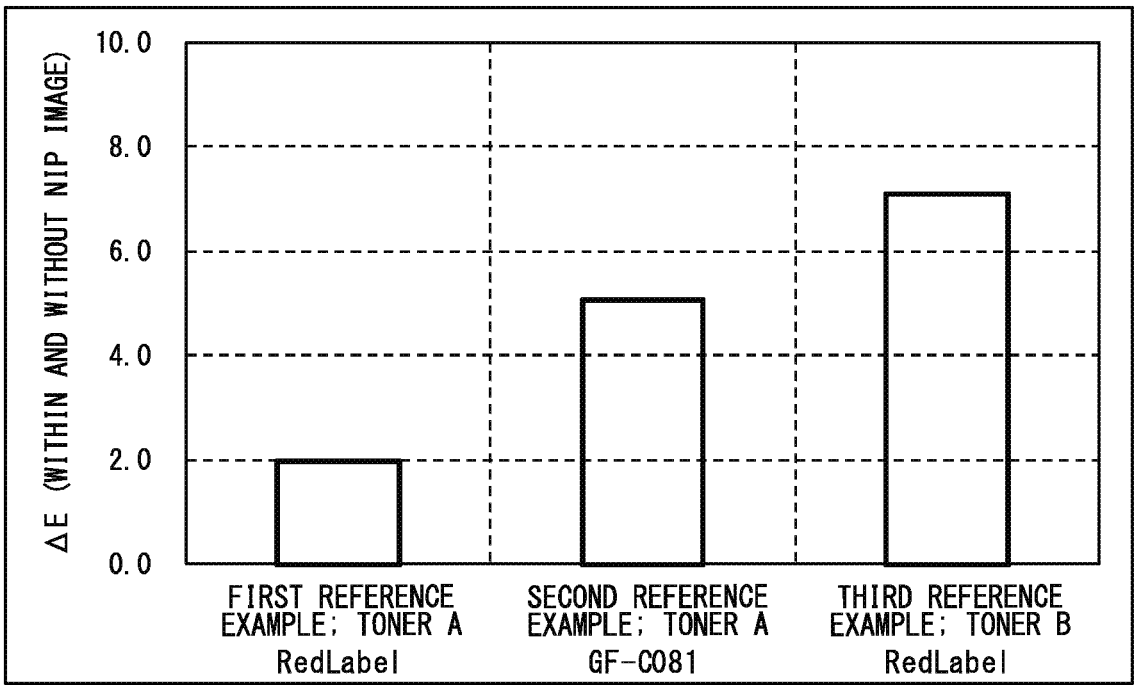
FIG. 23A is a graph indicating color differences within and without of the nip image in first through third reference examples.

Types of Toner and Sheet Used for Measurement Sheet and Relationship with Color Difference and Glossiness Difference Here, types of toner and sheet used for the measurement sheet and a relationship with a color difference and a glossiness difference at the boundary of the nip image will be described with reference to FIGS. 23A and 23B. FIG. 23A indicates color difference within and without the nip image in first through third reference examples and FIG. 23B indicates glossiness differences within and without the nip image in the first through third reference examples. It is noted that in all of the reference examples in FIGS. 23A and 23B, monochromatic solid coating images of only toner A or B are formed as the inspection images on the measurement sheets.

The first reference example is a case in which the toner A and the RedLabel sheet (80 g/m$^2$) are used for the measurement sheet. The second reference example is a case in which the toner A and a Canon GF-0081 sheet (81.4 g/m$^2$) are used for the measurement sheet. The third reference example is a case in which the toner B and the RedLabel sheet (80 g/m$^2$) are used for the measurement sheet. While the toners A and B are black toners based on polystyrene, a glass transition point Tg of the polystyrene used for the toner B is higher than that of the polystyrene of the toner A by about 10° C.

Still further, the color difference ΔE within and without the nip image is a color difference between the nip image and the area of the inspection image 400 other than the nip image IM calculated by lightness L of a Lab color space and complementary dimension (a and b). Specifically, it is possible to obtain the color difference ΔE from Li, ai and bi measured values in an image portion in the area within the nip image and from Lj, aj and bj measured values in an image portion in the area without the nip image. Here, the color difference ΔE is found from the following equation 2 which is a CIE1976 color difference calculation formula:

$$\Delta E=\sqrt{(Lj-Li)^2+(aj-ai)^2+(bj-bi)^2} \quad (2)$$

It is noted that the respective L, a and b values were measured by a spectro-photomemter 'Spectrolino' (made by GretagMacbeth Corp.).

Figure 23B:
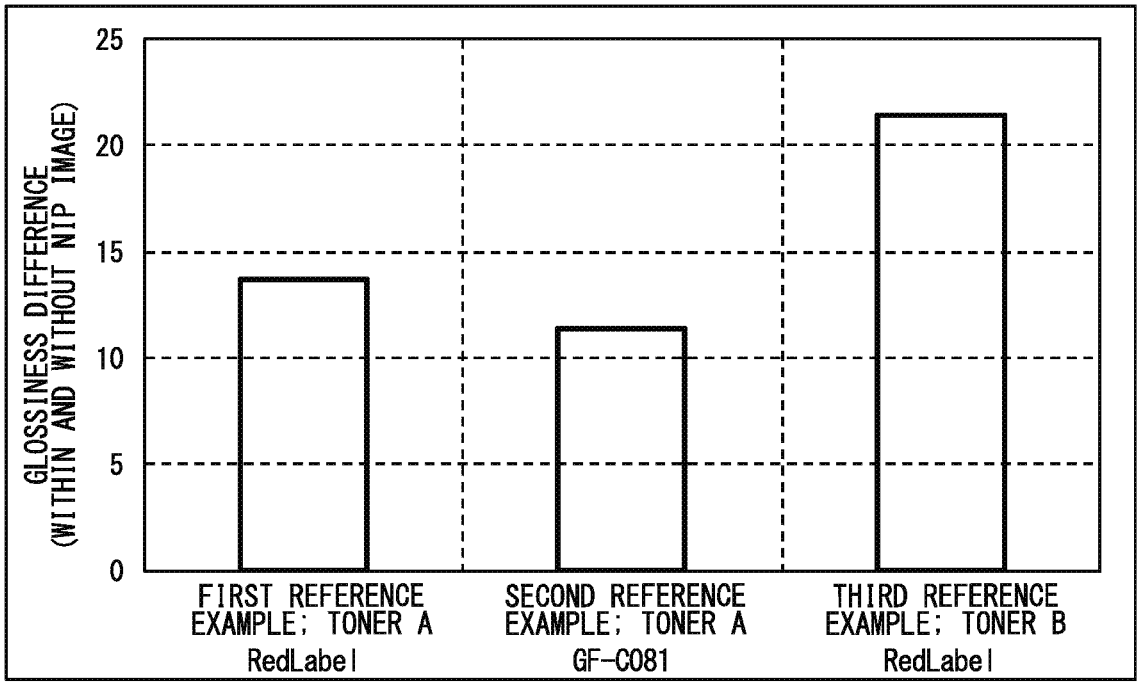
FIG. 23B is a graph indicating glossiness differences within and without the nip image in the first through third reference examples.

The glossiness difference indicated in FIG. 23B is a difference between glossiness of the image portion in the area within the nip image and glossiness of the image portion in the area without the nip image in the solid black image on the measurement sheet. It is noted that the respective glossiness were measured by a glossimeter PG-1 (75°, made by Nippon Denshoku Industries Co., Ltd).

As it can be seen from FIGS. 23A and 23B, the color difference ΔE and the glossiness difference are biggest in a combination of the toner and the sheet of the third reference example, and the fixing nip width can be measured readily from the nip image. Both of the color difference ΔE and the glossiness difference in the first reference example using the toner A are lower than those of the third reference example. While the color difference ΔE of the second reference example using the GF-CO81 sheet is larger than that of the first reference example, the glossiness difference thereof is lower than that of the first reference example.

Thus, the color difference ΔE and the glossiness difference are influenced by melting characteristics of the toner to be used and a surface nature of the sheet. Accordingly, there is a case where it is hard to measure the nip image depending on types of the toner and the sheet to be used. Then, it becomes necessary to prepare a combination of toner and sheet by which the color difference ΔE and the glossiness difference become large in advance. Then, according to the fourth exemplary embodiment, the nip image which facilitates the measurement is formed by forming the inspection image 400 under the following conditions.

Condition for Forming Inspection Image

The inspection image 400 formed on the measurement sheet Pm of the fourth exemplary embodiment includes a plurality of toner layers. That is, the inspection image 400 includes a first toner layer which is an uppermost layer and a second toner layer which is adjacent to the first toner layer in a state in which the inspection image 400 is transferred onto the measurement sheet Pm. In other words, the first toner layer is a toner layer separated most from a surface of the sheet within the plurality of toner layers and the second toner layer is a toner layer separated next from the surface of the sheet.

The first toner layer is formed by a first color toner and the second toner layer is formed by a second color toner which is different from the first color. That is, the inspection image 400 is composed of two or more color toners. In the fourth exemplary embodiment, the first color is a chromatic color except of black and white.

The following description will be made by defining a toner covering rate per unit area in a toner printing range of a sheet as an image coverage. For instance, consider a case where the inspection image 400, in which yellow toner (100% of image coverage) is used to form the first toner layer as the uppermost layer and black toner (100% of image coverage) is used to form the second toner layer as an under layer of the uppermost layer, is formed on the measurement sheet Pm. In this case, the inspection image 400 becomes a blackish-yellow color.

If the conveyance of the measurement sheet Pm is stopped in a state in which such inspection image 400 is nipped by the fixing nip N2, the first toner layer melts and increases transparency, so that the toner color of the second toner layer develops color in appearance. In the abovementioned case for example, the nip image IM which is the area nipped by the fixing nip N2 becomes a blackish-dark color as compared to the other area of the inspection image 400. Accordingly, it is possible to increase the color difference ΔE within and without the nip image IM as compared to the inspection image formed by the monochromatic toner and to form the nip image IM which can be readily measured.

Still further, the first toner layer of the uppermost layer is selected at this time from a toner color other than the black toner. Because black is an absorption color of incident light, the toner color of the second layer is hardly developed even if melting advances in the pause step of the measurement sheet Pm and the color difference ΔE within and without the nip image IM cannot be increased. Still further, although the printer 100B of the fourth exemplary embodiment is not provided with white toner, it is not also preferable as the first toner layer. In general, because the white toner has highly opacifying characteristics by increasing refraction and scattering of incident light to realize white color, the white toner is unable to increase the development of the toner color of the second layer by melting and is unsuitable for such use of the present disclosure.

Note that although it is not always an essential condition, it is desirable to select a toner color having large lightness (L) in the Lab color space as a toner color of the first toner layer with respect to a toner color of the second toner layer. A reason thereof is the same with not using the black toner as the first toner layer, i.e., to be free of an impediment to color formation of the toner color of the second toner layer in melting in the pausing step of the sheet.

Figure 14:
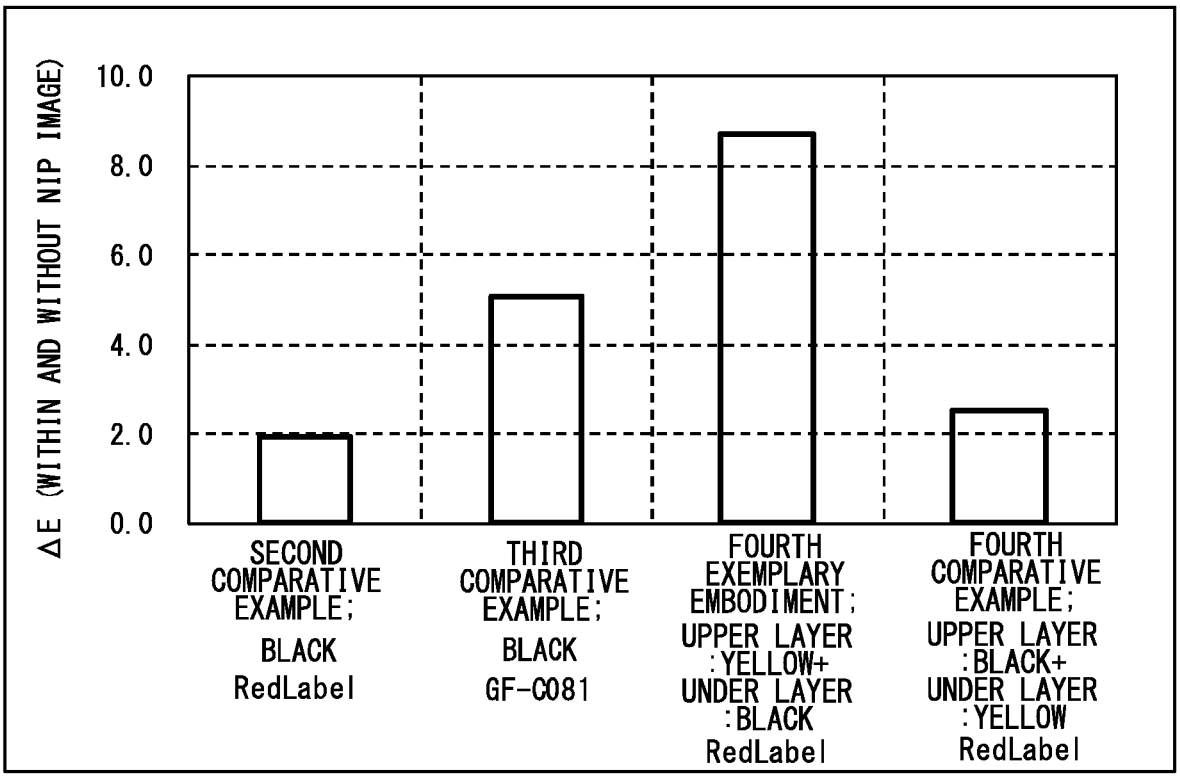
FIG. 14 is a graph indicating color differences within and without the nip image in each example.

FIG. 14 illustrates specific examples of the above description. FIG. 14 illustrates color differences ΔE within and without the nip image in second through fourth comparative examples and in the fourth exemplary embodiment. Method for calculating the color difference ΔE is the same with the method described in connection with FIG. 23.

The second comparative example is a case in which black toner (100% of image coverage) and the RedLabel sheet (80 $g/m^2$) are used for the measurement sheet Pm. The third comparative example is a case in which black toner (100% of image coverage) and the Canon GF-CO81 sheet (81.4 $g/m^2$) are used for the measurement sheet Pm. The fourth exemplary embodiment is a case in which the inspection image 400 is composed of a first toner layer using yellow toner (100% of image coverage) and a second toner layer using black toner (100% of image coverage) and in which the RedLabel sheet (80 $g/m^2$) is used for the measurement sheet Pm. The fourth comparative example is a case in which the inspection image 400 is composed of a first toner layer using black toner (100% of image coverage) and a second toner layer using yellow toner (100% of image coverage) and in which the RedLabel sheet (80 $g/m^2$) is used for the measurement sheet Pm.

The second and third comparative examples are the same respectively with the first and second reference examples described in connection with FIG. 23A. As illustrated in FIG. 14, the color difference ΔE is remarkably large in the case of the fourth exemplary embodiment as compared to the second comparative example, so that the boundary of the nip image IM is clearer and the measurement of the nip image IM is facilitated. Still further, as compared with the third comparative example, it is possible to increase the color difference ΔE while using the same RedLabel sheet and to obtain excellent visibility by the fourth exemplary embodiment. Meanwhile, the color difference ΔE of the fourth comparative example in which an order of lamination of the first and second toner layers is replaced with respect to the fourth exemplary embodiment is almost the same with that of the second comparative example.

Next, an optimum condition in forming the inspection image 400 to be formed on the measurement sheet Pm by the plurality of toner colors will be described.

At first, while the inspection image 400 of the measurement sheet Pm needs not be always the combination of the toner images having 100% of image coverage like the fourth exemplary embodiment and a toner image having low image coverage may be used. However, the image coverage of the toner is preferable to be 20% or more. It is because in a case where the image coverage is less than 20%, concentration as a toner image is lowered and it is unable to increase the color difference ΔE even after going through the pausing step of the sheet (see Step S17 in FIG. 12).

Figure 15:
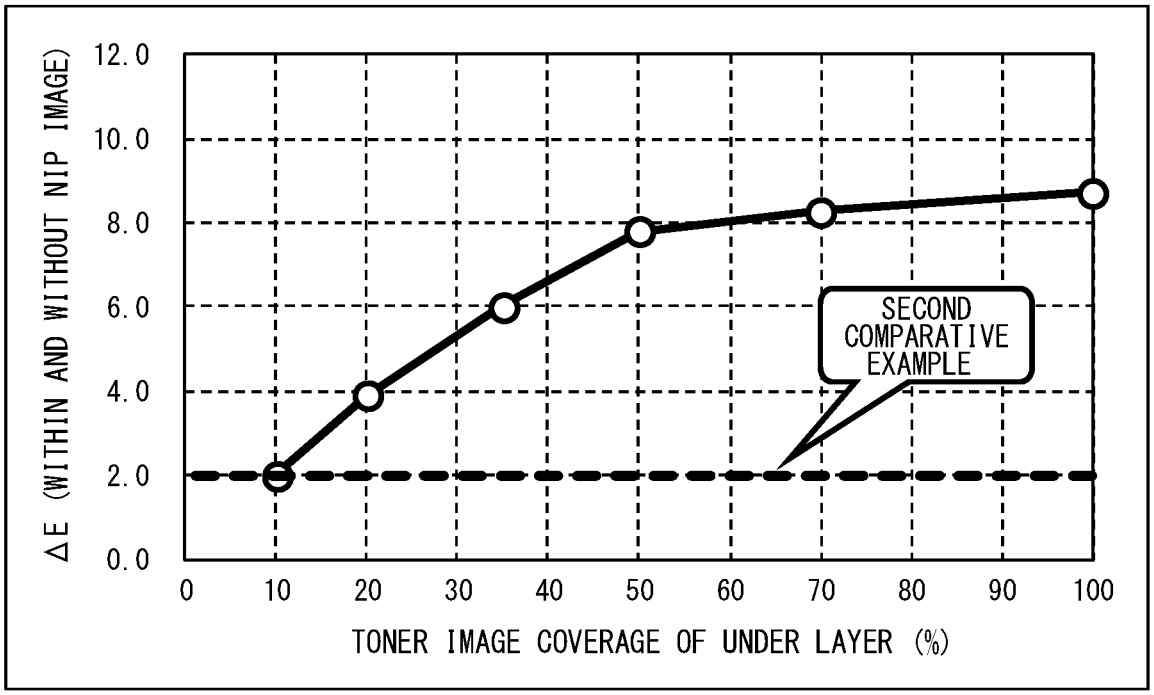
FIG. 15 is a graph indicating a relationship between an image coverage of a second toner layer and the color difference within and without the nip image.

FIG. 15 is a graph illustrating a relationship between the image coverage of the second toner layer, i.e., the under layer, and the color difference ΔE within and without the nip image IM. In the present case, yellow toner (100% of image coverage) is used for the first toner layer, black toner is used for the second toner layer and a Canon RedLabel sheet (80 $g/m^2$) is used for the measurement sheet Pm. FIG. 15 also indicates the color difference ΔE of the third comparative example by a broken line as a criterion.

As illustrated in FIG. 15, it is possible to clearly increase the color difference ΔE by the combination of yellow toner and black toner when the image coverage of the black toner is set to be greater than or equal to 20% and less than or equal to 100% as compared to the second comparative example in which the inspection image 400 is formed only by black toner. Meanwhile, the color difference ΔE is equal with that of the second comparative example when the image coverage of the black toner is 10%. Accordingly, it is preferable to set the image coverage of the black toner of the second toner layer to be 20% or more and is more preferable to set the image coverage of the second toner layer to be 50% or more.

The image coverage of the first toner layer is also set to be equal to or more than the image coverage of the second toner layer. More preferably, the image coverage per unit area of the first toner layer is larger than the image coverage per unit area of the second toner layer within the area in which the inspection image 400 is formed. It is because it is not necessary to opacify the development of color of the second toner layer by the first toner layer in the area other than the area of the nip image IM in the inspection image 400 on the measurement sheet Pm.

Next, in forming the inspection image 400 by the plurality of toner colors, the combination of the toner colors of the first and second toner layers is a combination by which a color difference ΔE' among toner colors in the Lab color space is largest within the toner colors stored in the storage portion 26 (see FIG. 10).

Figure 16:
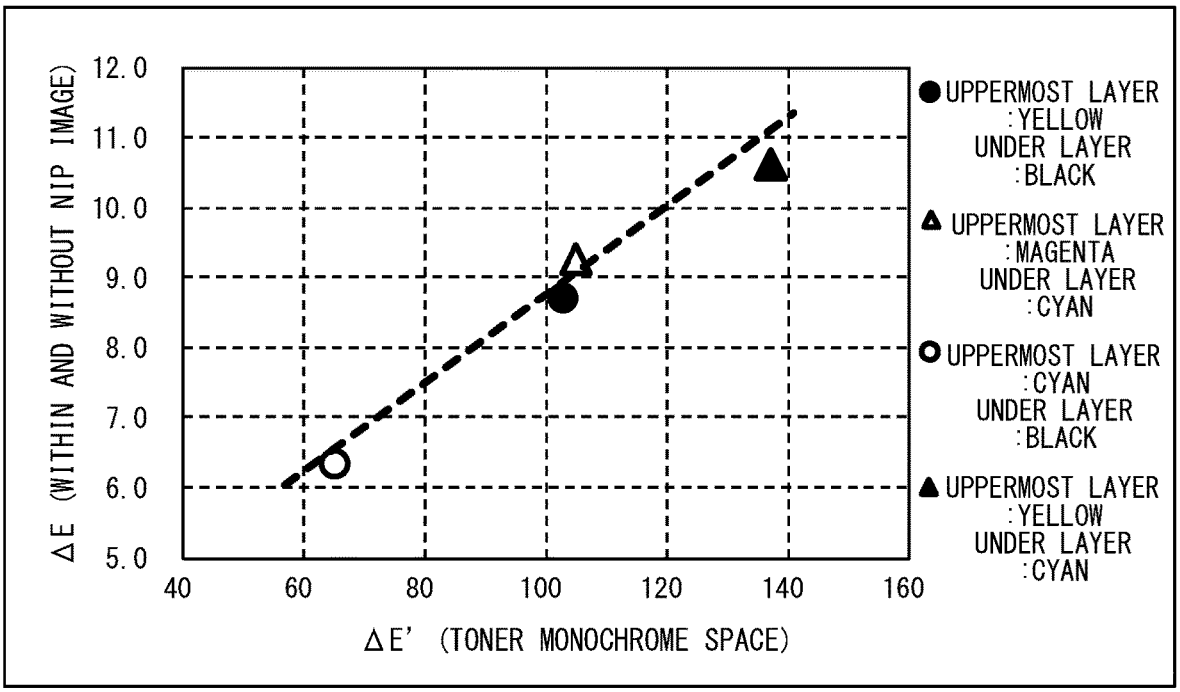
FIG. 16 is a graph indicating a relationship between color differences among toner colors and the color difference within and without of the nip image.

FIG. 16 is a graph illustrating a relationship between the color difference ΔE' between toner colors and the color difference ΔE within and without the nip image IM. It is noted that in the case in FIG. 16, the Canon RedLabel sheet (80 $g/m^2$) is used for the measurement sheet Pm and the inspection image 400 is composed of two color toners. In FIG. 16, points in cases where the first and second toner layers are formed respectively by yellow and black toners, magenta and cyan toners, cyan and black toners and yellow and cyan toners are plotted. Note that these toners are used for the inspection image 400 with 100% of image coverage.

As it is apparent from FIG. 16, the color difference ΔE within and without the nip image IM is directly proportional to the color difference ΔE' among monochromatic toners. Accordingly, it is preferable to use yellow toner for the first toner layer and to use cyan toner for the second toner layer in the printer 100B of the present exemplary embodiment. However, it is necessary to grasp the color difference ΔE' among the monochromatic toners in advance because such toner characteristics are different per every toner.

Figure 12:
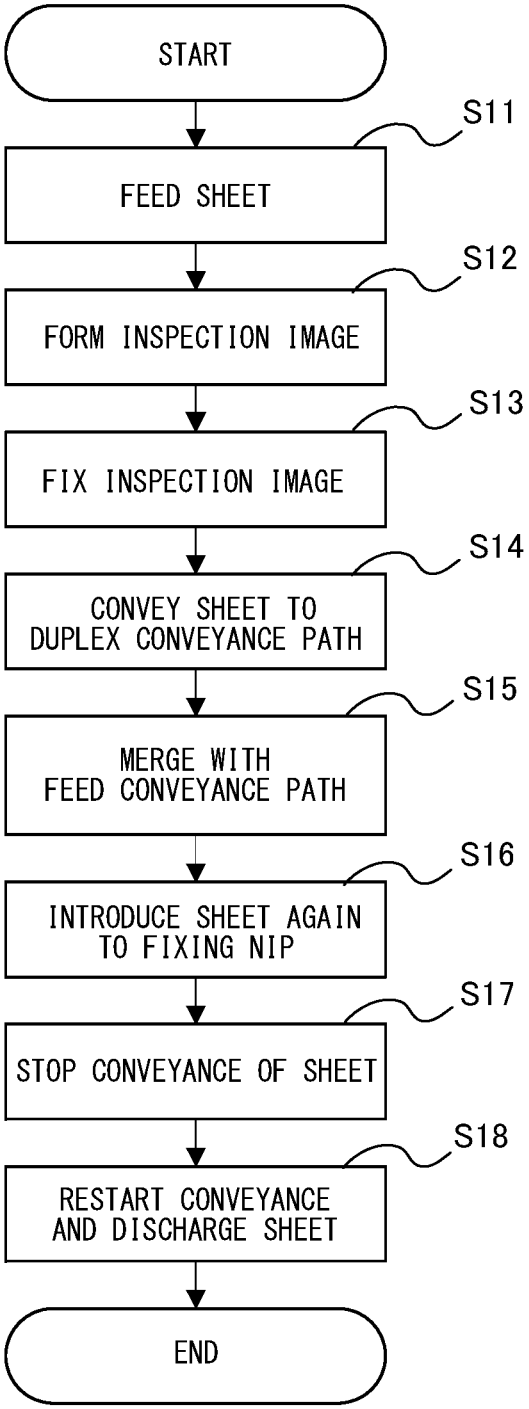
FIG. 12 is a flowchart illustrating operations of an inspection mode.

Next, the target temperature of the fixing heater 33 in Step S13 in FIG. 12 is set to be lower than the target temperature of the fixing heater 33 when the non-fixed toner image passes through the fixing nip N2 in a mode different from the inspection mode. In other words, in the mode different from the inspection mode, the temperature of the fixing heater 33 when the non-fixed toner image passes through the fixing nip N2 is set to a third temperature. Then, the temperature of the fixing heater 33 when the non-fixed inspection image 400 passes through the fixing nip N2 in the inspection mode is set to be a fourth temperature which is lower than the third temperature.

Note that the heat quantity applied from the fixing unit 30 to the measurement sheet Pm and the non-fixed toner image, i.e., the inspection image 400, may be lower than a heat quantity applied from the fixing unit 30 during a normal printing process in Step S13 in FIG. 12 without changing the target temperature of the fixing heater 33. For instance, the fixing unit 30 may be provided with an adjustment mechanism for adjusting a pressurizing force of the pressurizing stay 35 to set a nipping pressure of the fixing nip N2 to be lower than that during the normal printing process in Step S13 in FIG. 12.

Figure 17:
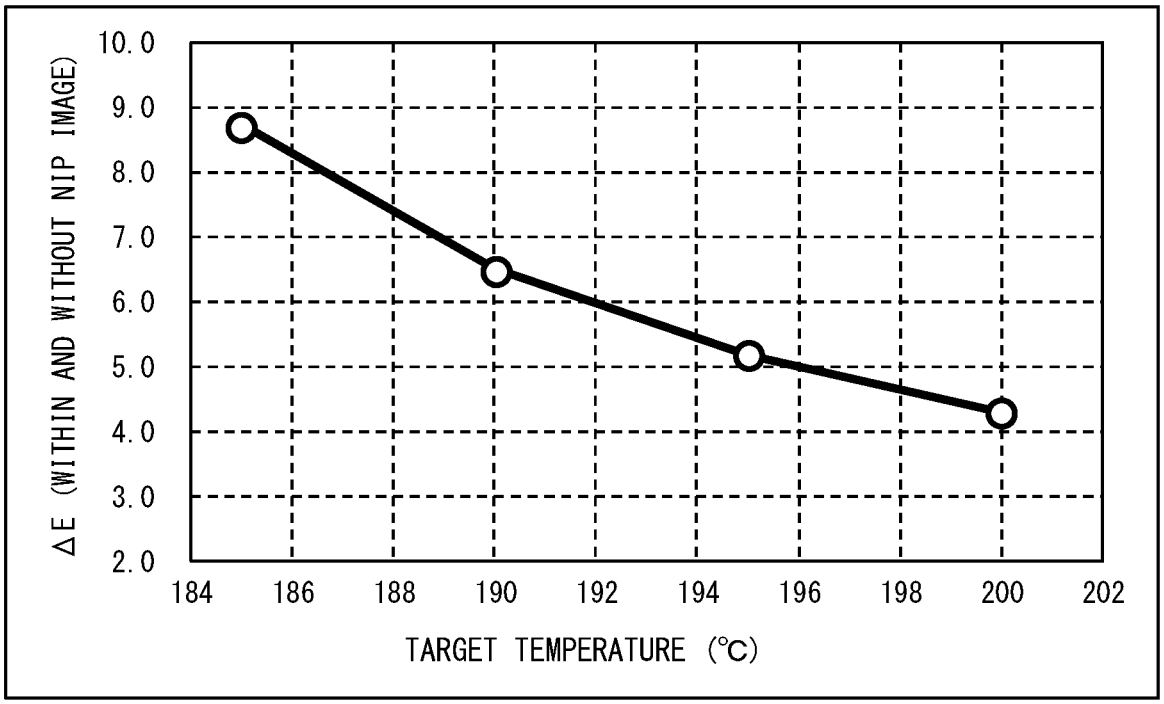
FIG. 17 is a graph indicating a relationship between a target temperature of a fixing heater in fixing a non-fixed inspection image and a color difference within and without the nip image of the fourth exemplary embodiment.

FIG. 17 is a graph representing a relationship between the target temperature Ttg of the fixing heater 33 in fixing the non-fixed inspection image 400 of the fourth exemplary embodiment and the color difference ΔE within and without the nip image IM. As it is apparent from FIG. 17, the lower the target temperature Ttg, the larger the color difference ΔE is. It is because the opacifying property of the second toner layer by the first toner layer can be increased because melting of the toner does not advance and transparency of the first toner layer becomes low if the non-fixed toner image is fixed in a lower temperature. That is, the development of color of the first toner layer becomes stronger in the inspection image 400 in the area other than the nip image IM in the state in which the nip image IM is formed within the inspection image 400. Meanwhile, because the first toner layer fully melts in Step S17 in FIG. 12 in the area of the nip image IM, it is possible to increase the color difference ΔE within and without the nip image IM and to form the nip image IM that can be more readily measured.

Still further, because the inspection image 400 is prepared for the purpose of measuring the nip image IM, it is not necessary to have resistance against external stresses such as scratching, bending and pasting and un-pasting of a tape like a normal image. Still further, the inspection image 400 needs not to have stability of image quality in keeping for a long time. Accordingly, it is possible to lower the target temperature Ttg of the inspection image 400 on the sheet PM as long as fixability is assured to a degree of not staining the conveyance path of the printer 100B by the toner image. While the target temperature Ttg of the fixing heater 33 in forming a normal image is set at 200° C. as described above, the target temperature Ttg of the fixing heater 33 in Step S13 in FIG. 12 is set at 185° C. in the present exemplary embodiment.

The nip image IM is measured by using the sheet PM configured and prepared through the steps as described above and a measurement unit such as a ruler and a caliper. The content to be measured is the fixing nip width L3. A difference of the fixing nip widths at a widthwise center position and at an end position of the nip image IM or the like are also measured. It is possible to reduce variation of measured length per measurer in the present exemplary embodiment because the color difference ΔE within and without the nip image IM is large and the fixing nip width L3 can be measured readily.

Information on the fixing nip width L3 thus obtained is inputted through the operating portion 210 of the printer 100B and is stored in the RAM 203 or the ROM 204 of the control portion 200. Then, the control portion 200 changes the target temperature Ttg of the fixing heater 33 based on the fixing nip width L3 thus stored or based on the fixing nip width L3 at the widthwise center position of the nip image IM in particular.

Figure 18:
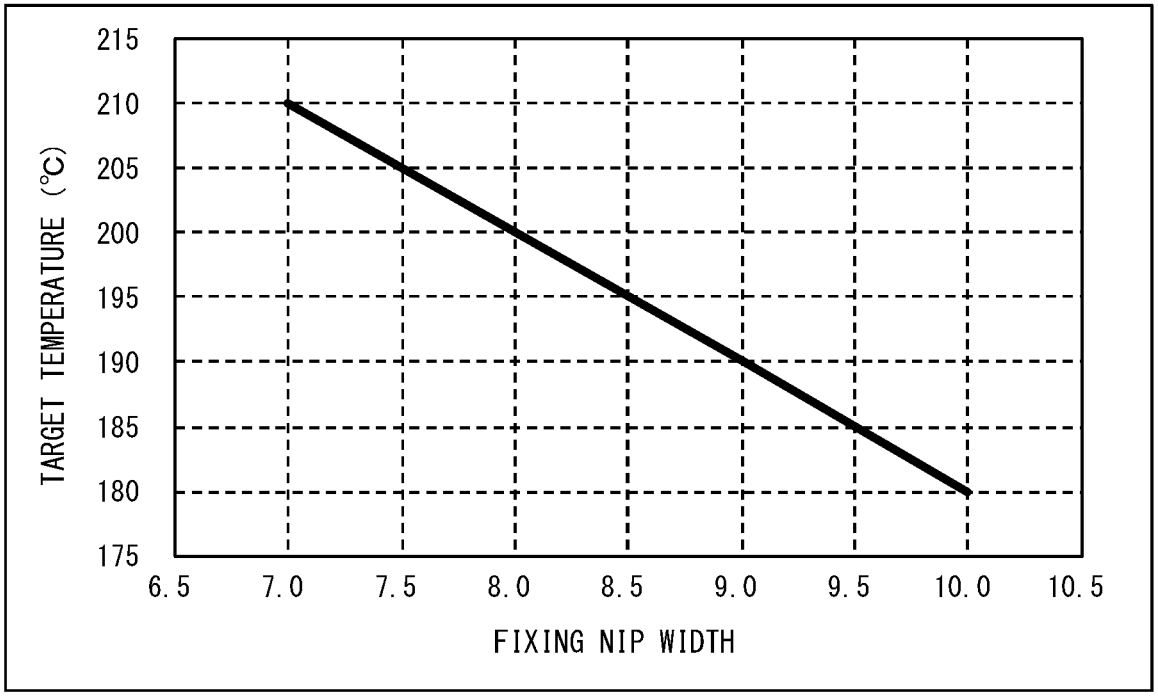
FIG. 18 is a graph indicating a relationship between the fixing nip width and the target temperature of the fixing heater.

FIG. 18 is a graph illustrating a relationship between the fixing nip width L3 and the target temperature Ttg of the fixing heater 33 of the present exemplary embodiment. As illustrated in FIG. 18, the larger the fixing nip width L3, the lower the target temperature Ttg of the fixing heater 33 set by the control portion 200 is and the smaller the fixing nip width L3, the higher the target temperature Ttg of the fixing heater 33 set by the control portion 200 is. In other words, the control portion 200 sets the target temperature Ttg at a first temperature when the fixing nip width L3 is a first width and the control portion 200 sets the target temperature Ttg at a second temperature lower than the first temperature when the fixing nip width L3 is a second width larger than the first width.

It is possible to suppress performance variation of the fixing unit 30 by controlling the target temperature Ttg as described above. It is also possible to respond to characteristic changes caused by durability of the fixing unit 30 and to obtain more stable fixing performance by periodically executing the inspection mode to change the target temperature Ttg.

It is noted that while the printer 100B of the present exemplary embodiment has changed the target temperature Ttg corresponding to the fixing nip width L3, it is also possible to change the nipping pressure of the fixing nip N2 corresponding to the fixing nip width L3 by providing an adjustment mechanism for adjusting the pressurizing force of the pressurizing stay 35. Still further, because the larger the fixing nip width L3, the higher a conveyance force of the fixing unit 30 applied to the sheet PP is, a rotational speed of the fixing motor 230 for driving the pressure roller 32 may be changed corresponding to the fixing nip width L3.

Still further, in a case where a fixing nip width L3 measured during the use of the printer 100B changes by exceeding a specified value set in advance with respect to a fixing nip width L3 measured in an initial state of the printer 100B, the information related to a service life of the fixing unit 30 may be notified to the user. The information related to the service life includes a notification that the service life has come and a notice of the service life and is notified through the operating portion 210 of the printer 100B, the host computer and others. Still further, the printer 100B may be connected with Internet to transmit the information related to the service life of the fixing unit 30 to an outside manager of the printer 100B, e.g., to a service man, through the network. Such arrangement of the notification of the service life of the fixing unit 30 makes it possible to reduce an occurrence of image defects caused by using the fixing unit 30 in a range of exceeding the service life of the fixing unit 30. Still further, the plurality of these controls using the fixing nip width L3 may be performed simultaneously.

As described above, the printer 100B forms the inspection image 400 in which the plurality of toner layers is laminated on the measurement sheet Pm in the inspection mode. Then, it is possible to increase the color difference ΔE within and without the nip image IM and to measure the nip image IM more readily by forming the first toner layer, i.e., the uppermost layer, of the inspection image 400 on the measurement sheet Pm by a chromatic color.

Fifth Exemplary Embodiment

Next, while a fifth exemplary embodiment of the present disclosure will be described below, the fifth exemplary embodiment is constructed by adding a reading unit 44 to the printer of the fourth exemplary embodiment. Therefore, components similar to those of the fourth exemplary embodiment will be described by denoting the same reference signs or their illustrations will be omitted here.

Figure 19:
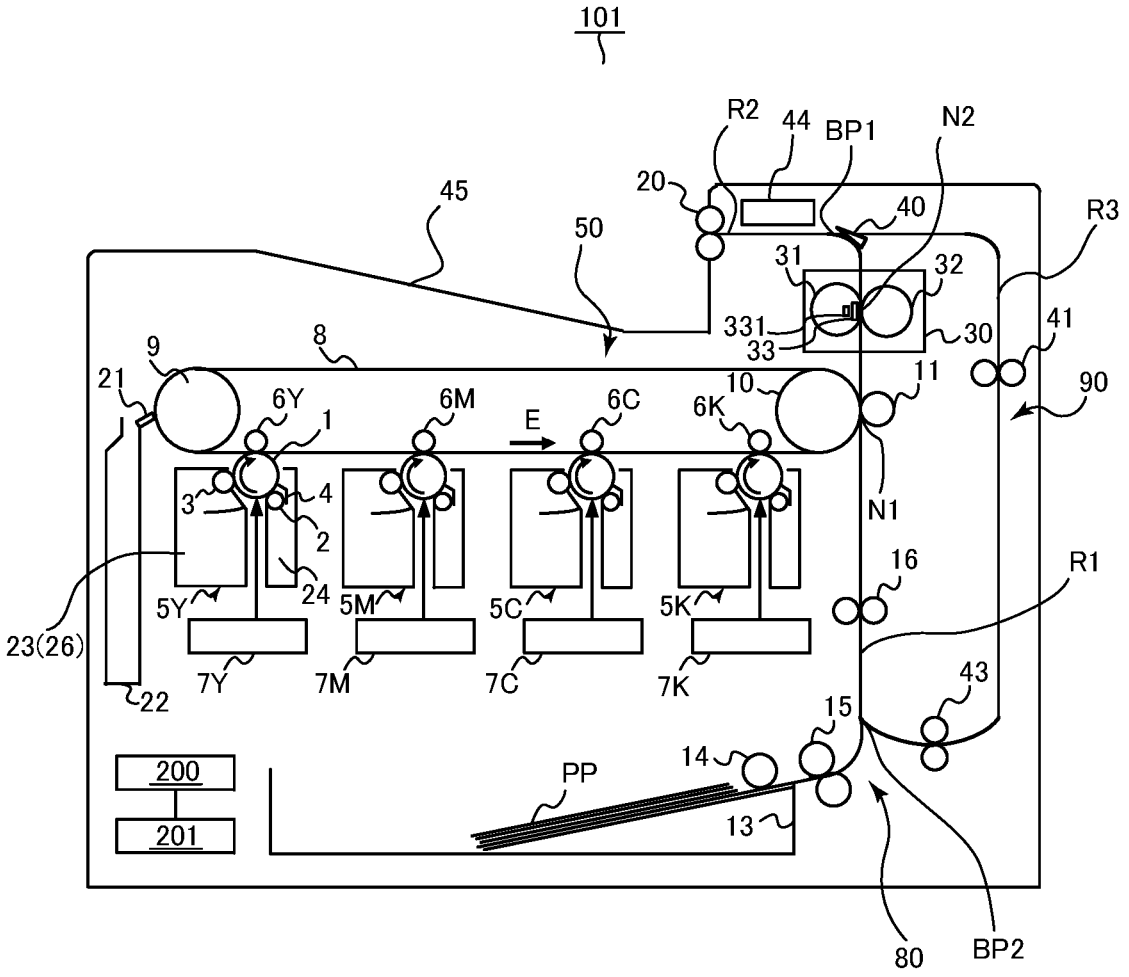
FIG. 19 is a schematic diagram illustrating an overall configuration of a printer of a fifth exemplary embodiment.

As illustrated in FIG. 19, a printer 101 of the fifth exemplary embodiment includes the reading unit 44 for reading an image on the sheet PP. The reading unit 44 is disposed along the discharge conveyance path R2 which is a conveyance path between the fixing nip N2 and the discharge roller pair 20 serving as a discharge portion. The reading unit 44 is also disposed so as to face a surface of the sheet facing to the pressure roller 32 in passing through the fixing nip N2.

The reading unit 44 includes a light emitting element and a CIS (Contact Image Sensor) not illustrated and is configured to read a widthwise entire area of the sheet P. The reading unit 44 photo-electrically reads the inspection image 400 on the measurement sheet Pm being conveyed as a pixel signal and stores as image data in the RAM 203 of the control portion 200 after converting into RGB digital image data. The CIS can read with resolution of 300 dpi in the sheet conveyance direction. Note that a CMOS sensor or a CCD sensor may be applied instead of the CIS.

Still further, because it is possible to improve reading accuracy of the reading unit 44 by delaying a conveyance speed of the measurement sheet Pm passing through a reading position of the reading unit 44, the conveyance speed of the printer 101 in Step S18 in FIG. 12 is lowered than that in forming a normal image. More specifically, while the conveyance speed of the sheet in forming a normal image is 240 mm/s, the conveyance speed of the sheet in passing through the reading position of the reading unit 44 is set at 80 mm/s in the inspection mode.

Figure 20:
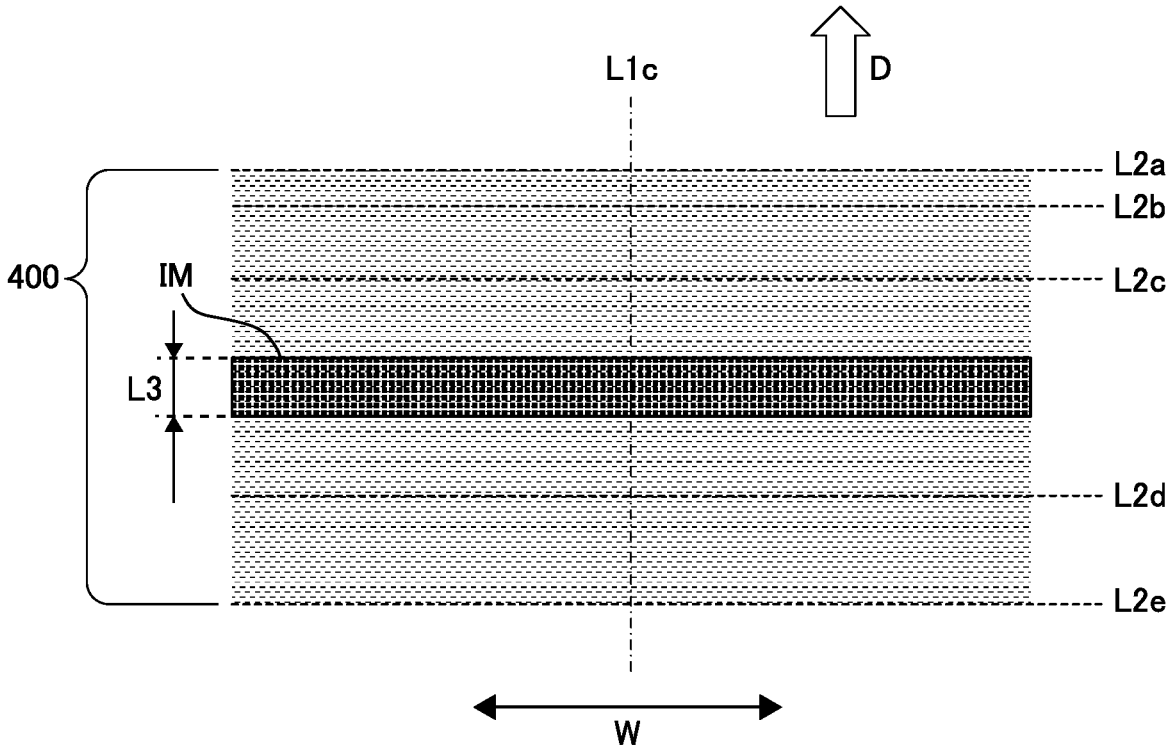
FIG. 20 illustrates a read example of a nip image by a reading unit.

FIG. 20 illustrates an example of the nip image IM read by the reading unit 44. It is noted that the measurement of the fixing nip width L3 is made at the widthwise center position L1*c* of the nip image IM for convenience of the description in the fifth exemplary embodiment, the present disclosure is not limited to such arrangement. For instance, the fixing nip width L3 may be measured at a plurality of widthwise positions of the nip image IM and their values may be averaged.

The reading unit 44 reads with pitch of 300 dpi in the sheet conveyance direction D of the measurement sheet Pm. Here, the reading unit 44 reads from a leading edge position L2*a* to a trailing edge position L2*e* of the inspection image 400 and stores the read data as RGB data in the RAM 203 of the control portion 200.

In succession, the control portion 200 detects the fixing nip width L3 by using the read data stored in the RAM 203. Upon converting the RGB data into Lab data, the control portion 200 averages the Lab data per one pixel of a range from the position L2*b* to the position L2*c* in FIG. 20 to calculate as Lab(av). A reason why the control portion 200 does not adopt a range from the leading edge position L2*a* as a calculation range to provide a margin on dispersion such as conveyance accuracy of the measurement sheet Pm and a writing position of the inspection image 400. A length from the leading edge position L2*a* to the position L2*b* is 6 mm (71 pixels) and a length from the leading edge position L2*a* to the position L2*c* is 16 mm (189 pixels) in the fifth exemplary embodiment.

Figure 21:
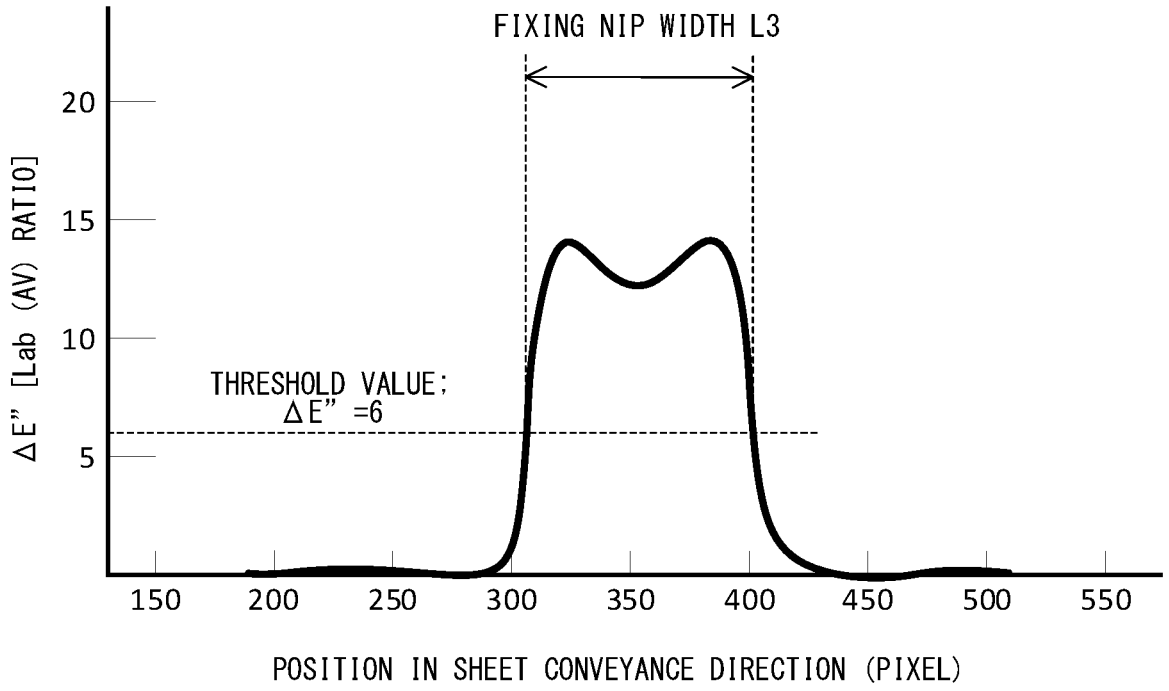
FIG. 21 is a graph indicating a color difference at each position in the sheet conveyance direction.

Next, the control portion 200 calculates a color difference ΔE" with respect to the Lab(av) on Lab data of one pixel in a range from the position L2*c* to a position L2*d*. The range from the position L2*c* to the position L2*d* is set to include the nip image IM, and a length from the leading edge position L2*a* to the position L2*d* is 44 mm (519 pixels) in the fifth exemplary embodiment. It is noted that a method for calculating the color difference ΔE" is the same with the method described in the fourth exemplary embodiment. FIG. 21 illustrates its result.

FIG. 21 is a graph indicating the color difference ΔE" at each position in the sheet conveyance direction D. Because the Lab value at a position outside of the area of the nip image IM in the inspection image 400 is almost equal with Lab(av), the color difference ΔE" remains almost around zero. Meanwhile, the Lab value within the area of the nip image IM differs from the Lab(av), and the color difference ΔE" increases.

Next, the control portion 200 sets a threshold value on the color difference ΔE" in order to remove dispersion of the color difference ΔE" and an unclear range of the nip image IM. For instance, as illustrated in FIG. 21, the control portion 200 sets as color difference ΔE"=6 and obtains a length in the sheet conveyance direction D corresponding to a range more than or equal to this threshold value as the fixing nip width L3. The printer 101 automatically measures the nip image IM on the measurement sheet Pm and concludes the measurement of the fixing nip width L3 within the printer 101 by performing the steps as described above.

Figure 22:
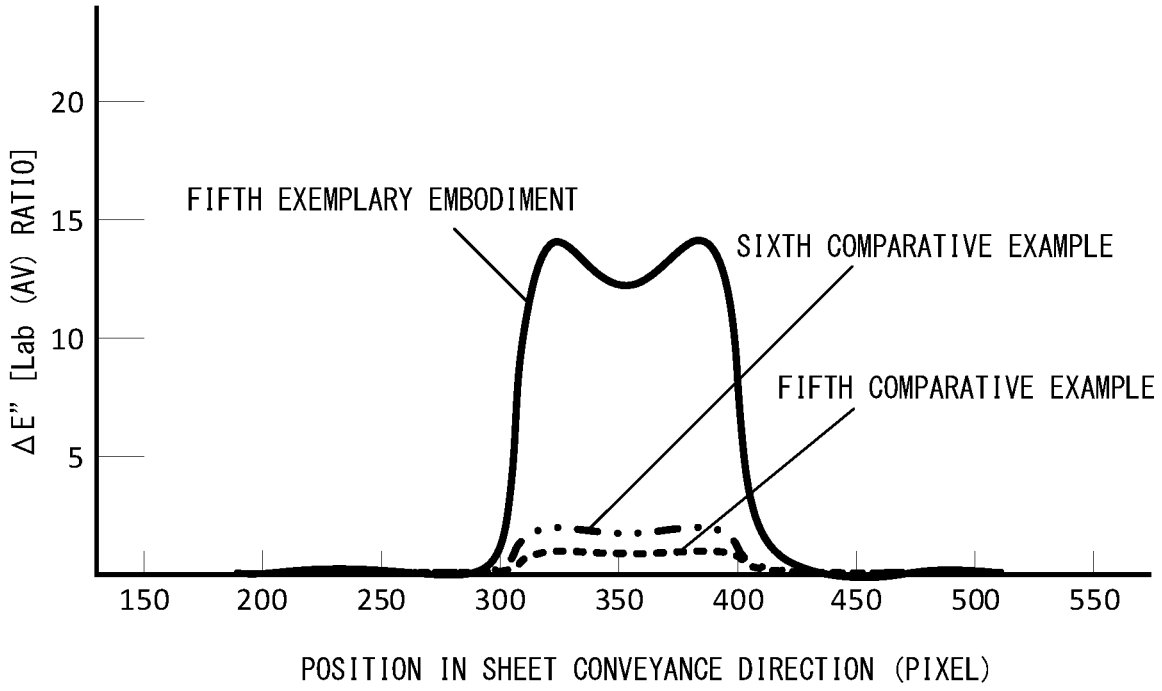
FIG. 22 is a graph indicating a color difference at each position in the sheet conveyance direction in the respective exemplary embodiments.

FIG. 22 is a graph indicating the color difference ΔE" at each position in the sheet conveyance direction D in the fifth exemplary embodiment and in fifth and sixth comparative examples. The nip image IM is read as described above also in these fifth exemplary embodiment and in the fifth and sixth comparative examples. The fifth exemplary embodiment is a case in which the inspection image 400 is composed of a first toner layer using yellow toner (100% of image coverage) and a second toner layer using black toner (100% of image coverage) and in which the RedLabel sheet (80 g/m$^2$) is used for the measurement sheet Pm. The fifth comparative example is a case in which black toner (100% of image coverage) and the RedLabel sheet (80 g/m$^2$) are used for the measurement sheet Pm. The sixth comparative example is a case in which black toner (100% of image coverage) and the Canon GF-CO81 sheet (81.4 g/m$^2$) are used for the measurement sheet Pm. The result of the fifth exemplary embodiment is the same with the result illustrated in FIG. 21.

As illustrated in FIG. 22, a maximum value of the color difference ΔE" of the fifth comparative example is as small as around 1, and it is hard to read the nip image IM by the reading unit 44. A maximum value of the color difference ΔE" of the six comparative example in which the measurement sheet Pm is changed to the GF-CO81 sheet is also as small as around 2, it is hard to read the nip image IM by the reading unit 44.

Meanwhile, a maximum value of the color difference ΔE" of the fifth exemplary embodiment is as large as around 12 to 14, so that the nip image IM can be distinguished from the area other than the nip image IM of the inspection image 400 and the nip image IM can be readily read by the reading unit 44. Note that a reason why the color differences of the fifth and sixth comparative examples and the fifth exemplary embodiment are larger than the color differences of the second and third comparative examples and the fourth exemplary embodiment is that image density reading characteristics of an ordinary CIS is different from that of a spectrophotometer such Spectrolino.

As described above, the nip image IM can be readily read also in the case of reading the nip image IM by the reading unit 44 by forming the inspection image 400 by laminating the plurality of color toner layers and by forming the first toner layer, i.e., the uppermost layer, of the sheet by a chromatic color. Therefore, it is possible to obtain the fixing nip width L3 more accurately.

The target temperature Ttg of the fixing heater 33, the pressurizing force of the pressurizing stay 35, the rotational speed of the fixing motor 230 or the like may be changed based on the fixing nip width L3 thus obtained also in the fifth exemplary embodiment. The information concerning the service life of the fixing unit 30 may be also notified. According to the fifth exemplary embodiment, because the reading unit 44 automatically reads the nip image IM in the process of discharging the measurement sheet Pm onto the discharge tray 45 by executing the inspection mode, no work of the user or a manager of the printer 101 is necessary. Still further, because the fixing nip width L3 is automatically measured without going through operator's assistance, it is possible to measure the fixing nip width L3 periodically and seamlessly, to stabilize the performance of the fixing unit 30 and to manage the service life of the fixing unit 30 accurately.

Other Exemplary Embodiments

It is noted that while the sheet is deflected in the direction of keeping the sheet away from the fixing film 31 by stopping the conveyance of the sheet being conveyed by the transfer nip N1 after stopping the conveyance of the sheet being conveyed by the fixing nip N2, the present disclosure is not limited to such arrangement. For instance, the conveyance of the sheet by the transfer nip N1 and the fixing nip N2 may be stopped simultaneously in a state in which the sheet is deflected in advance by slowing down the conveyance speed of the sheet at the fixing nip N2 more than the conveyance speed of the sheet at the transfer nip N1.

Note that the first through fifth exemplary embodiments may be appropriately combined. The control temperature of the fixing unit 30 may be also set similarly to the control temperature in the fixing operation of the normal toner image in Step S5 in FIG. 5 in the second and third exemplary embodiments.

Still further, the reading unit 44 may not be provided along the duplex conveyance path R3 in the first through third exemplary embodiments, and the reading unit 44 may be provided along the discharge conveyance path R2 for example Still further, while the reading unit 44 is disposed along the discharge conveyance path R2 in the printer 101 of the fifth exemplary embodiment, the present disclosure is not limited to such arrangement. For instance, the reading unit 44 may be disposed along another conveyance path other than the discharge conveyance path R2 and may be disposed along the duplex conveyance path R3 for example. In a case where an image forming apparatus is provided with a reading unit such as a flatbed scanner, the measurement sheet Pm may be read by the flatbed scanner.

Still further, the automatic measurement mode has been executed under an instruction of the user in the first through third exemplary embodiments, the present disclosure is not limited to such arrangement and the automatic measurement mode may be executed automatically at timing set in advance. Still further, in a case of executing the automatic measurement mode by the instruction of the user, the printer may inform and urge the user to execute the automatic measurement mode.

Still further, while the chromatic color toner is used for the first toner layer in the fourth and fifth exemplary embodiments, color of the toner used for the second toner layer is not limited. However, the color of the toner used for the second toner layer is preferable if its lightness is lower than the color of the toner used for the first toner layer.

Still further, while the printer uses the four colors of yellow, magenta, cyan and black in the fourth and fifth exemplary embodiments, the present disclosure is not limited to such arrangement. It is preferable if a combination of colors of toners used for the first and second toner layers is a combination having a largest color difference in the Lab color space also in a printer using toner other than those four color toners.

Still further, while the inspection mode is executed under the instruction of the user in the fourth and fifth exemplary embodiments, the present disclosure is not limited to such arrangement and the inspection mode may be automatically executed at a timing set in advance. In a case where the inspection mode is executed under the instruction of the user, the printer may inform and urge the user to execute the inspection mode.

Still further, while the fixing unit 30 includes the fixing film 31 in all of exemplary embodiments described above, the present disclosure is not limited to such arrangement. For instance, a fixing roller in which an IH heater or a ceramic heater is built in may be applied instead of the fixing film 31.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-159000, filed Aug. 30, 2019, and Japanese Patent Application No. 2019-159001, filed Aug. 30, 2019, which are hereby incorporated by reference herein in their entirety.

What is claimed is:

1. An image forming apparatus, comprising:

an image bearing member configured to bear a non-fixed toner image;

a transfer portion configured to form a transfer nip together with the image bearing member and to transfer the non-fixed toner image borne on the image bearing member onto a sheet at the transfer nip;

a fixing portion including a first rotary member, a second rotary member forming a fixing nip together with the first rotary member and a heating portion configured to heat the first rotary member, the fixing portion being configured to fix the non-fixed toner image to the sheet as a fixed toner image by heat and pressure at the fixing nip;

a re-conveyance portion configured to convey the sheet that has passed through the fixing portion toward the fixing portion again;

a control portion configured to execute a nip image forming process of forming a nip image, on the sheet, corresponding to a shape of the fixing nip by stopping a conveyance of the sheet being conveyed by the fixing portion in a state in which the fixed toner image formed on the sheet is nipped by the fixing nip; and a reading unit configured to read the nip image, wherein the control portion sets the heating portion to a first temperature in a case where the non-fixed toner image passes through the fixing nip and sets the heating portion to a second temperature which is lower than the first temperature in a case where the nip image passes through the fixing nip after the nip image is formed on the sheet and before the reading unit reads the nip image.

2. The image forming apparatus according to claim 1, wherein the control portion stops the conveyance of the sheet being conveyed by the fixing nip and the transfer nip in a state in which the sheet does not come into contact with a part of the first rotary member other than the fixing nip in the nip image forming process.

3. The image forming apparatus according to claim 2, wherein the control portion stops the conveyance of the sheet being conveyed by the fixing portion after when a trailing edge of the sheet passes through the transfer portion in the nip image forming process.

4. The image forming apparatus according to claim 3, wherein the transfer nip is located on a same side with the first rotary member with respect to a tangential line of the first and second rotary members in the fixing nip.

5. The image forming apparatus according to claim 2, wherein the control portion stops the conveyance of the sheet being conveyed by the transfer nip after stopping the conveyance of the sheet being conveyed by the fixing nip in a state in which the sheet is nipped by the fixing nip and the transfer nip in the nip image forming process.

6. The image forming apparatus according to claim 5, wherein the transfer nip is located on a same side with the first rotary member with respect to a tangential line of the first and second rotary members in the fixing nip.

7. The image forming apparatus according to claim 1, wherein the second rotary member stops in a state being in contact with the fixed toner image in the nip image forming process.

8. The image forming apparatus according to claim 1, wherein the re-conveyance portion comprises a re-conveyance path through which the sheet passes through, and wherein the reading unit is disposed along the re-conveyance path.

9. The image forming apparatus according to claim 8, wherein the reading unit is disposed so as to face a first surface, onto which the non-fixed toner image is transferred by the transfer portion, of the sheet passing through the re-conveyance path for a first time.

10. The image forming apparatus according to claim 1, wherein the control portion obtains a width of the fixing nip in a sheet conveyance direction based on the nip image read by the reading unit and controls the heating portion based on the width.

11. An image forming apparatus, comprising:

an image forming unit comprising an image bearing member configured to bear a non-fixed toner image, a transfer portion configured to form a transfer nip together with the image bearing member and to transfer the non-fixed toner image borne onto the image bearing member to a sheet at the transfer nip, and a storage portion configured to store toners of a plurality of colors;

a fixing portion including a first rotary member, a second rotary member forming a fixing nip together with the first rotary member, and a heating portion configured to heat the first rotary member, the fixing portion being configured to fix the non-fixed toner image to the sheet as a fixed toner image by heat and pressure at the fixing nip; and a control portion configured to execute an inspection mode of preparing a measurement sheet used to measure a shape of the fixing nip, wherein the control portion executes, in the inspection mode, an inspection image forming process of transferring and fixing an inspection image formed by laminating a plurality of toner layers onto the sheet, and a nip image forming process of forming a nip image corresponding to the shape of the fixing nip by stopping a conveyance of the sheet being conveyed by the fixing portion in a state in which the inspection image is nipped by the fixing nip, wherein the plurality of toner layers transferred onto the sheet by the transfer portion includes a first toner layer which is an uppermost layer formed by a first color toner, and a second toner layer formed adjacent to the first toner layer and formed by a second color toner different from the first color, wherein the first color is a chromatic color, and wherein an image coverage per unit area of the first toner layer is larger than an image coverage per unit area of the second toner layer within an area in which the inspection image is formed.

12. The image forming apparatus according to claim 11, wherein lightness of the second color is lower than that of the first color.

13. The image forming apparatus according to claim 11, wherein a combination of the first and second colors is a combination by which a color difference is largest in a Lab color space within colors of the toners stored in the storage portion.

14. The image forming apparatus according to claim 11, wherein the first color is yellow and the second color is cyan.

15. The image forming apparatus according to claim 11, wherein image coverages per unit area of the first and second toner layers within an area in which the inspection image is formed are greater than or equal to 20% and less than or equal to 100%, respectively.

16. An image forming apparatus, comprising:

an image forming unit comprising an image bearing member configured to bear a non-fixed toner image, a transfer portion configured to form a transfer nip together with the image bearing member and to transfer the non-fixed toner image borne onto the image bearing member to a sheet at the transfer nip, and a storage portion configured to store toners of a plurality of colors;

a fixing portion including a first rotary member, a second rotary member forming a fixing nip together with the first rotary member, and a heating portion configured to heat the first rotary member, the fixing portion being configured to fix the non-fixed toner image to the sheet as a fixed toner image by heat and pressure at the fixing nip; and a control portion configured to execute an inspection mode of preparing a measurement sheet used to measure a shape of the fixing nip, wherein the control portion executes, in the inspection mode, an inspection image forming process of transferring and fixing an inspection image formed by laminating a plurality of toner layers onto the sheet, and a nip image forming process of forming a nip image corresponding to the shape of the fixing nip by stopping a conveyance of the sheet being conveyed by the fixing portion in a state in which the inspection image is nipped by the fixing nip, wherein the plurality of toner layers transferred onto the sheet by the transfer portion includes a first toner layer which is an uppermost layer formed by a first color toner, and a second toner layer formed adjacent to the first toner layer and formed by a second color toner different from the first color, wherein the first color is a chromatic color, and wherein the control portion sets the heating portion to a third temperature in a case where the non-fixed toner image passes through the fixing nip in a mode different from the inspection mode, and sets the heating portion to a fourth temperature which is lower than the third temperature in a case where a non-fixed inspection image passes through the fixing nip in the inspection mode.

17. The image forming apparatus according to claim 11, wherein the second rotary member is stopped in a state of being in contact with the fixed toner image in the nip image forming process.

18. The image forming apparatus according to claim 11, further comprising a reading unit configured to read the nip image.

19. The image forming apparatus according to claim 18, further comprising a discharge portion configured to discharge a sheet out of the apparatus, wherein the reading unit is disposed along a conveyance path between the fixing nip and the discharge portion.

20. The image forming apparatus according to claim 18, wherein the control portion obtains a width of the fixing nip in a sheet conveyance direction based on the nip image read by the reading unit and controls the heating portion based on the width.

21. The image forming apparatus according to claim 1, wherein the first rotary member is a cylindrical film, and the heating portion is provided in an inner space of the film, and wherein the fixing nip is formed by the heating portion and the second rotary member through the film.

22. The image forming apparatus according to claim 11, wherein the first rotary member is a cylindrical film, and the heating portion is provided in an inner space of the film, and wherein the fixing nip is formed by the heating portion and the second rotary member through the film.

23. The image forming apparatus according to claim 16, wherein the first rotary member is a cylindrical film, and the heating portion is provided in an inner space of the film, and wherein the fixing nip is formed by the heating portion and the second rotary member through the film.

* * * * *